US010070689B2

(12) United States Patent
Orand

(10) Patent No.: US 10,070,689 B2
(45) **Date of Patent: *Sep. 11, 2018**

(54) SOLE STRUCTURE WITH ELECTRICALLY CONTROLLABLE DAMPING ELEMENT

(71) Applicant: NIKE, Inc., Beaverton, OR (US)

(72) Inventor: Austin Orand, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/724,693

(22) Filed: May 28, 2015

(65) Prior Publication Data

US 2016/0345670 A1 Dec. 1, 2016

(51) Int. Cl.

| | |
|---|---|
| ***A43B 13/20*** | (2006.01) |
| ***A43B 13/18*** | (2006.01) |
| ***A43B 7/14*** | (2006.01) |
| ***A43B 3/00*** | (2006.01) |

(52) U.S. Cl.

CPC ..... *A43B 13/189* (2013.01); *A43B 3/0005* (2013.01); *A43B 7/144* (2013.01); *A43B 7/145* (2013.01); *A43B 7/1445* (2013.01)

(58) Field of Classification Search

CPC ..... A43B 13/189; A43B 3/0005; A43B 7/144; A43B 7/1445; A43B 7/145

USPC ..... 36/28, 29

See application file for complete search history.

(56) References Cited

U.S. PATENT DOCUMENTS

| | | | | |
|---|---|---|---|---|
| 5,813,142 | A | 9/1998 | Demon | |
| 6,378,558 | B1 * | 4/2002 | Pohl | F16F 9/34 137/807 |
| 7,007,412 | B2 | 3/2006 | Munster | |
| 7,200,956 | B1 | 4/2007 | Kotha et al. | |
| 7,219,449 | B1 * | 5/2007 | Hoffberg | A43B 1/0054 36/29 |
| 7,254,908 | B2 | 8/2007 | Ungari | |
| 8,561,323 | B2 * | 10/2013 | Ellis | A43B 7/1425 36/103 |
| 8,567,095 | B2 * | 10/2013 | Ellis | A43B 7/1425 36/103 |
| 8,922,355 | B2 * | 12/2014 | Kusuura | G06F 3/00 340/407.1 |
| 8,959,804 | B2 | 2/2015 | Ellis | |
| 9,271,538 | B2 | 3/2016 | Ellis | |
| 9,743,712 | B2 * | 8/2017 | Orand | A43B 13/188 |
| 2003/0120353 | A1 * | 6/2003 | Christensen | A43B 3/0005 623/26 |
| 2006/0248749 | A1 * | 11/2006 | Ellis | A43B 3/0005 36/28 |
| 2006/0248750 | A1 | 11/2006 | Rosenberg | |
| 2010/0199524 | A1 | 8/2010 | Grun et al. | |

(Continued)

OTHER PUBLICATIONS

Sep. 9, 2016—(WO) ISR & WO—App. No. PCT/UW16/33247.

(Continued)

*Primary Examiner* — Jila M Mohandesi

(74) *Attorney, Agent, or Firm* — Banner & Witcoff, Ltd.

(57) ABSTRACT

A sole structure may include a damping pad. The damping pad may include a chamber, a foam element located within the chamber, an electrorheological fluid located within the chamber and at least partially permeating the foam element, and a set of electrodes positioned to create, in response to a voltage across the electrodes, an electrical field in at least a portion of the electrorheological fluid.

30 Claims, 17 Drawing Sheets

(56) References Cited

U.S. PATENT DOCUMENTS

| | | | | |
|---|---|---|---|---|
| 2013/0278436 | A1 | 10/2013 | Ellis | |
| 2014/0250726 | A1 * | 9/2014 | Meschter ..... | A43B 13/189 36/102 |

OTHER PUBLICATIONS

Demon, Ronald, "Black History in America" Internet Archive Wayback Machine, http://www.myblackhistor.net/Ronald_Demon.htm, Sep. 21, 2015, pp. 1-2.

* cited by examiner

SOLE STRUCTURE WITH ELECTRICALLY CONTROLLABLE DAMPING ELEMENT

BACKGROUND

Conventional articles of footwear generally include an upper and a sole structure. The upper provides a covering for the foot and securely positions the foot relative to the sole structure. The sole structure is secured to a lower portion of the upper and is configured so as to be positioned between the foot and the ground when a wearer is standing, walking, or running. The sole structure may include one or more cushioning elements. Those cushioning elements may help to attenuate and dissipate forces on a wearer foot that may result from ground impact during walking or running.

Conventionally, sole structures have been designed based on a particular condition or set of conditions, and/or based on a particular set of preferences and/or characteristics of a targeted shoe wearer. For example, cushioning elements may be sized and located based on expected movements of a shoe wearer associated with a particular type of sport. In many cases, the choice of cushioning elements may be a compromise among numerous possible alternatives. Because of variations among different individuals who might wear a particular shoe, however, some individuals may find a particular compromise to be less than satisfactory. A sole structure that allows adjustment of cushioning characteristics is thus desirable. There is an ongoing need for improved sole structures in which firmness can be modified based on individual wearer preference and/or in response to changing conditions.

SUMMARY

This Summary is provided to introduce a selection of concepts in a simplified form that are further described below in the Detailed Description. This Summary is not intended to identify key features or essential features of the invention.

In at least some embodiments, an article of footwear may comprise an upper and a sole structure coupled to the upper. The sole structure may include an electrically controllable damping pad positioned in a plantar region of the sole structure. The damping pad may include a chamber, a foam element located within the chamber, an electrorheological fluid located within the chamber and at least partially permeating the foam element, and a set of electrodes positioned to create, in response to a voltage across the electrodes, an electrical field in at least a portion of the electrorheological fluid.

In at least some embodiments, a sole structure may comprise an outsole and a midsole coupled to the outsole. The midsole may include an electrically controllable damping pad positioned in a plantar region of the sole structure. The damping pad may include a chamber, a foam element located within the chamber, an electrorheological fluid located within the chamber and at least partially permeating the foam element, and a set of electrodes positioned to create, in response to a voltage across the electrodes, an electrical field in at least a portion of the electrorheological fluid.

Additional embodiments are described herein.

BRIEF DESCRIPTION OF THE DRAWINGS

Some embodiments are illustrated by way of example, and not by way of limitation, in the figures of the accompanying drawings and in which like reference numerals refer to similar elements.

DETAILED DESCRIPTION

Figure 1:
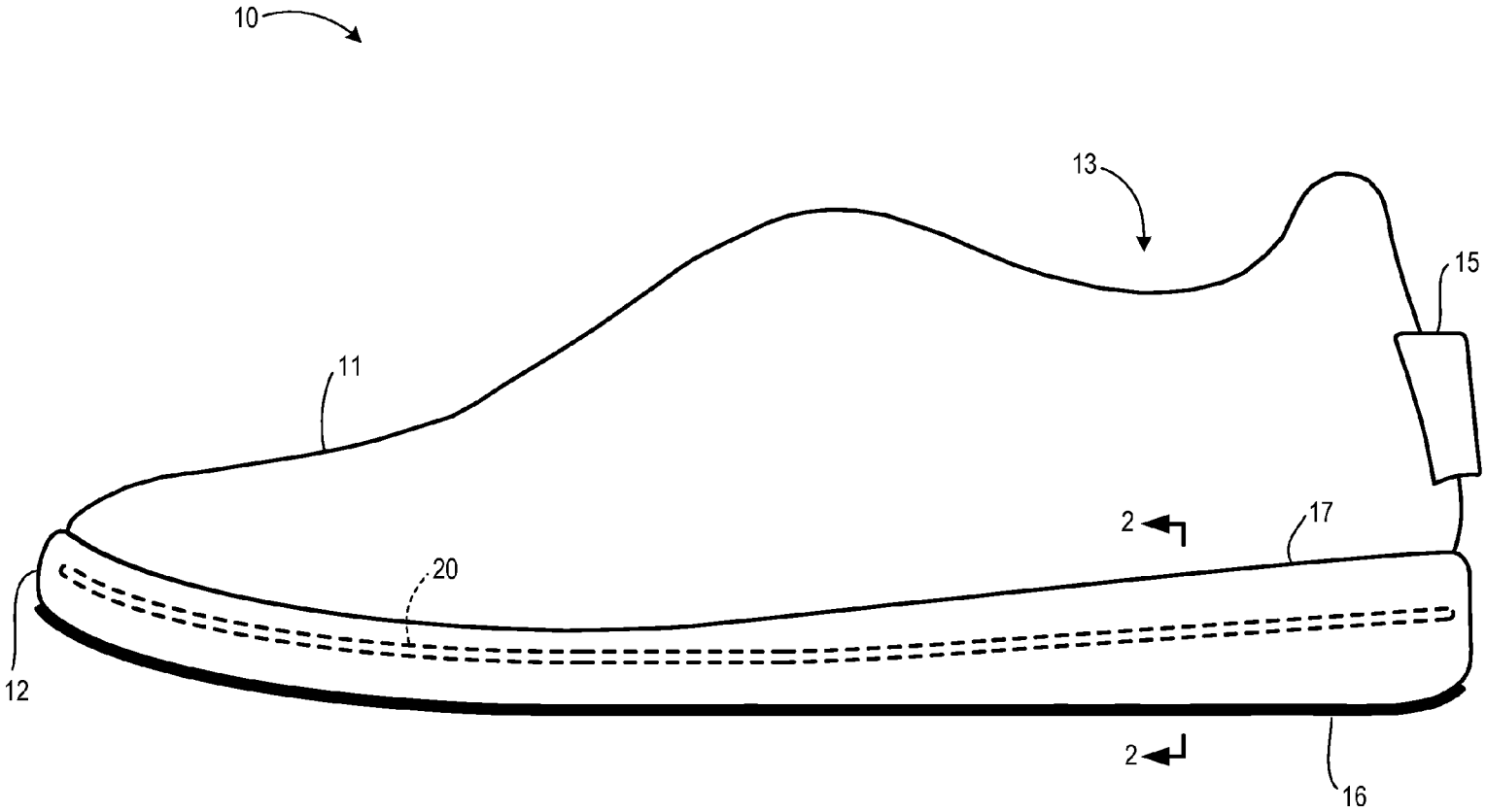
FIG. 1 is a medial side view of a shoe according to some embodiments.

In various types of activities, it may be advantageous to change characteristics of a sole structure. For example, some individuals may prefer a sole structure that is firmer in certain regions, while other individuals may prefer a sole structure that is firmer in different regions. In footwear according to some embodiments, one or more electrically controllable damping pads within a sole structure may be activated to selectively increase firmness in one or more regions of the damping pads. This increased firmness increases firmness of the sole structure in areas corresponding to those one or more regions of increased firmness.

In some embodiments, a damping pad may utilize an electrorheological (ER) fluid. ER fluids typically comprise a non-conducting oil or other fluid medium in which very small particles are suspended. In some types of ER fluid, the particles may have diameters of 5 microns or less and may be formed from polystyrene, polyurethane, or another polymer having a dipolar molecule. When an electric field is imposed across the ER fluid, the viscosity of the ER fluid increases as the strength of that field increases.

In some such embodiments, a damping pad may include a chamber that contains a foam element at least partially permeated with ER fluid. In a non-activated state, there is no electric field sufficient to raise ER fluid viscosity. In that non-activated state, ER fluid can flow in and out of cavities in the foam element, and the foam element is generally compressible in response to forces of magnitudes that may result from the weight of a shoe wearer during walking, running, or other activities. In an activated state, a sufficiently strong electric field is created in a portion of the foam element. This causes the viscosity of the ER fluid in that foam element portion to increase. That increased viscosity slows or prevents flow of the ER fluid in and out of cavities within that foam element portion subjected to the electrical field. As a result, the foam element portion subjected to the electric field becomes less compressible.

To assist and clarify subsequent description of various embodiments, various terms are defined herein. Unless context indicates otherwise, the following definitions apply throughout this specification (including the claims). "Shoe" and "article of footwear" are used interchangeably to refer to an article intended for wear on a human foot. A shoe may or may not enclose the entire foot of a wearer. For example, a shoe could include a sandal-like upper that exposes large portions of a wearing foot. The "interior" of a shoe refers to space that is occupied by a wearer's foot when the shoe is worn. An interior side, surface, face, or other aspect of a shoe component refers to a side, surface, face or other aspect of that component that is (or will be) oriented toward the shoe interior in a completed shoe. An exterior side, surface, face or other aspect of a component refers to a side, surface, face or other aspect of that component that is (or will be) oriented away from the shoe interior in the completed shoe. In some cases, the interior side, surface, face or other aspect of a component may have other elements between that interior side, surface, face or other aspect and the interior in the completed shoe. Similarly, an exterior side, surface, face or other aspect of a component may have other elements between that exterior side, surface, face or other aspect and the space external to the completed shoe.

Shoe elements can be described based on regions and/or anatomical structures of a human foot wearing that shoe, and by assuming that the interior of the shoe generally conforms to and is otherwise properly sized for the wearing foot. A forefoot region of a foot includes the heads and bodies of the metatarsals, as well as the phalanges. A forefoot element of a shoe is an element having one or more portions located under, over, to the lateral and/or medial side of, and/or in front of a wearer's forefoot (or portion thereof) when the shoe is worn. A midfoot region of a foot includes the cuboid, navicular, and cuneiforms, as well as the bases of the metatarsals. A midfoot element of a shoe is an element having one or more portions located under, over, and/or to the lateral and/or medial side of a wearer's midfoot (or portion thereof) when the shoe is worn. A heel region of a foot includes the talus and the calcaneus. A heel element of a shoe is an element having one or more portions located under, to the lateral and/or medial side of, and/or behind a wearer's heel (or portion thereof) when the shoe is worn. The forefoot region may overlap with the midfoot region, as may the midfoot and heel regions.

Unless indicated otherwise, a longitudinal axis refers to a horizontal heel-toe axis along the center of the foot that is roughly parallel to a line along the second metatarsal and second phalanges. A transverse axis refers to a horizontal axis across the foot that is generally perpendicular to a longitudinal axis. A longitudinal direction is generally parallel to a longitudinal axis. A transverse direction is generally parallel to a transverse axis.

FIG. 1 is a medial side view of a shoe 10 according to some embodiments. The lateral side of shoe 10 has a similar configuration and appearance, but is configured to correspond to a lateral side of a wearer foot. Shoe 10 is configured for wear on a right foot and is part of a pair that includes a shoe (not shown) that is a mirror image of shoe 10 and is configured for wear on a left foot.

Shoe 10 includes an upper 11 attached to a sole structure 12. Upper 11 may be a conventional upper formed from any of various types or materials and have any of a variety of different constructions. Upper 11 includes an ankle opening 13 through which a wearer foot may be inserted into an interior void defined by the upper. Laces, straps, and/or other types of tightening elements may be included to cinch upper 11 about a wearer foot. To avoid obscuring the drawing with unnecessary detail, tightening elements and other features of upper 11 are omitted from FIG. 1. Upper 11 may be lasted with a strobel or in some other manner and bonded to sole structure 12. A battery assembly 15 is attached to upper 11 in a rear heel region and includes a battery that provides electrical power to a controller. The controller is not visible in FIG. 1, but is further discussed below and described in connection with FIGS. 13 and 14.

Sole structure 12 may include an outsole 16 attached to a midsole 17. Outsole 16 may include lugs, a tread pattern, and/or or other surface features, not shown, to enhance traction. Outsole 16 may be formed from natural and/or synthetic rubber, and/or other elastomer(s) and/or other conventional outsole materials.

Midsole 17 includes one or more cushioning elements. Such cushioning elements may include one or more pieces of compressed EVA (ethylene vinyl acetate) and/or other type of polymer foam. Cushioning elements may also or alternatively include one or more fluid-filled bladders filled with a gas or a liquid and that are compressible in response to applied force from the weight of a shoe wearer. Examples of fluid-filled bladders that may be included in sole structures according to some embodiments include, without limitation, bladders such as those described in U.S. Pat. No. 8,479,412, U.S. Pat. No. 8,381,418, U.S. Pat. No. 7,131,218, U.S. Pat. No. 8,813,389, US patent application publication number 2012/0102783, and US patent application publication number 2012/0102782. All of said patents and patent application publications are incorporated by reference herein. In addition to reducing impact on a wearer foot during walking, running, and other activities, the cushioning elements within midsole 17 may be contoured to provide support for a wearer foot.

As shown in FIG. 1 with broken lines, midsole 17 may further include an electrically-activated damping pad 20. Damping pad 20 may act as a cushioning element, but is also electrically controllable so as to increase firmness in one or more zones so as to dampen the cushioning of the damping pad in that zone. As explained in more detail below, damping pad 20 includes a chamber that contains a foam element and an ER fluid. The ER fluid at least partially permeates the foam element. Electrodes within the chamber are positioned to create electrical fields in one or more zones of damping pad 20. When such a field is created, the viscosity of the ER fluid in the affected zone increases. As a result, the firmness of damping pad 20 in that zone also increases.

In the embodiment of FIG. 1, sole structure 12 includes a single damping pad 20 that generally extends the length and width of sole structure 12. In other embodiments, a sole structure may multiple damping pads and/or damping pads confined to certain regions of a sole structure. Several such embodiments are described below.

Figure 2:
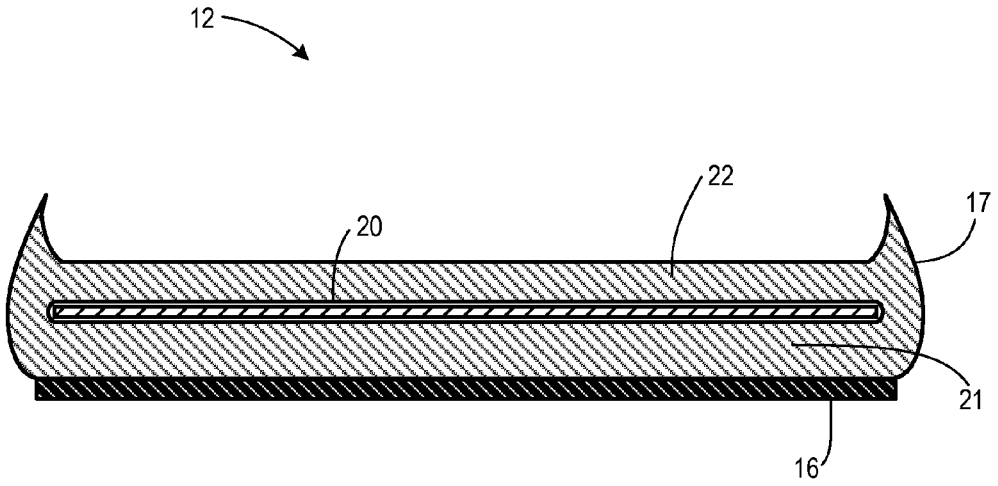
FIG. 2 is an area cross-sectional view taken from the location indicated in FIG. 1.

FIG. 2 is an area cross-sectional view of sole structure 12 from the location indicated in FIG. 1. Damping pad 20 is embedded within midsole 17 and positioned between a bottom foam layer 21 and a top foam layer 22. In the embodiment of FIG. 2, bottom foam layer 21 and top foam layer 22 are portions of a single-piece polymer foam element into which damping pad 20 was placed during a molding process. In other embodiments, foam elements of a midsole may be separate pieces. For example, midsole 17 could be formed to comprise a first piece that includes a bottom layer and side walls that form a pocket. A damping pad could be placed into that pocket, and a top foam layer formed as a separate piece then placed over the damping pad.

Figure 3A:
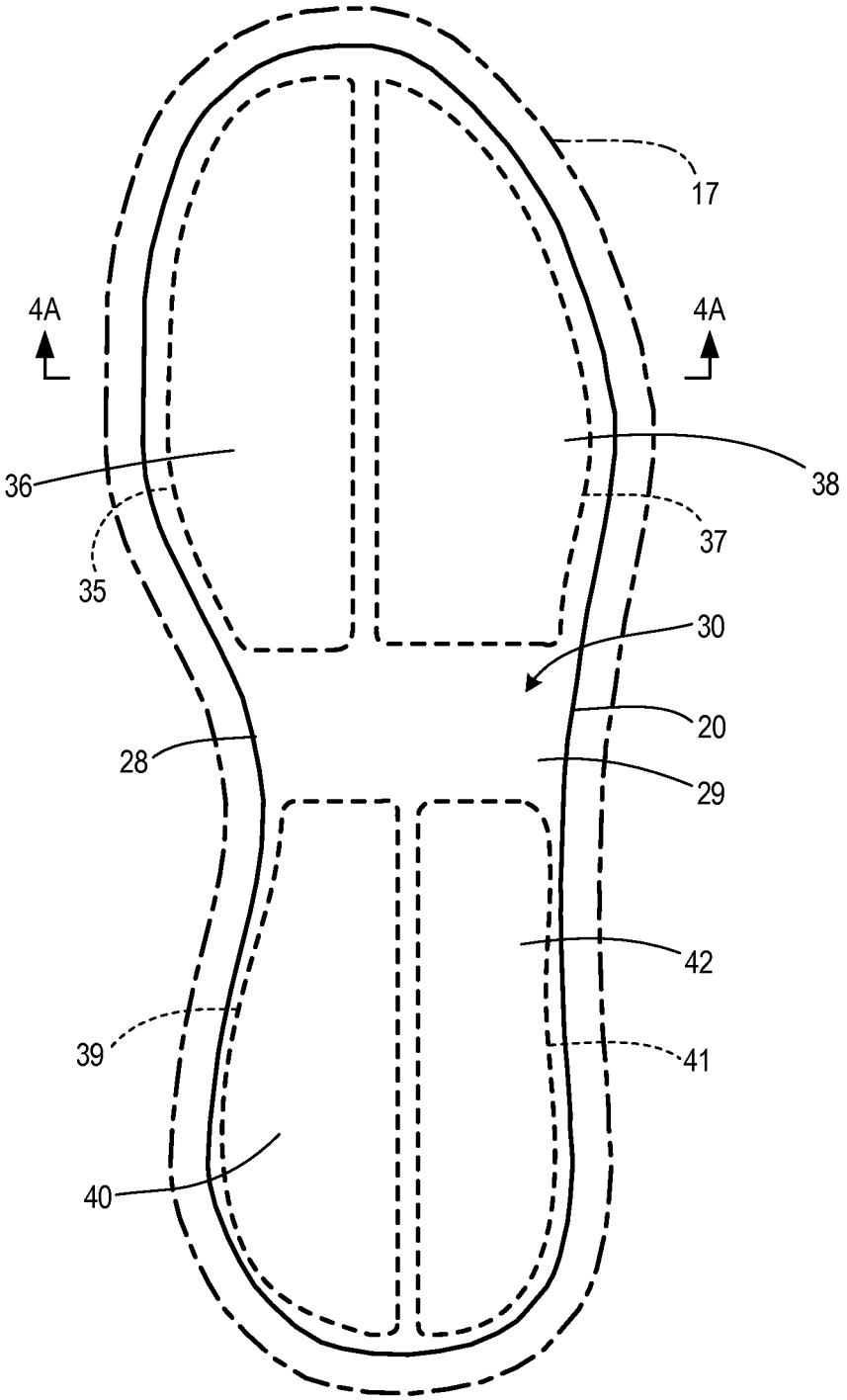
FIG. 3A is a top view of an electrically controllable damping pad from the shoe of FIG. 1.

FIG. 3A is a top view of damping pad 20 separated from other components of sole structure 12. Uneven broken lines show an outline of the midsole 17 peripheral boundary and indicate the lateral and longitudinal position of damping pad 20 within midsole 17. Damping pad 20 is located in forefoot, midfoot, and heel plantar regions of sole structure 12. In the embodiment of shoe 10, damping pad 20 extends substantially the entire length and width of midsole 17 and of sole structure 12. In some embodiments, a damping pad extends substantially the entire length of a midsole or sole structure if the damping pad has an overall length that is at least 80% of an overall length of the midsole or sole structure. In some such embodiments, a damping pad extends substantially the entire width of a midsole or sole structure if a damping pad portion has a width that is at least 80% of the width of the midsole or sole structure in the region that contains that damping pad portion. In some embodiments, a damping pad may extend all the way to the sides of a midsole or other sole structure element and be visible from outside the sole structure.

Figure 3B:
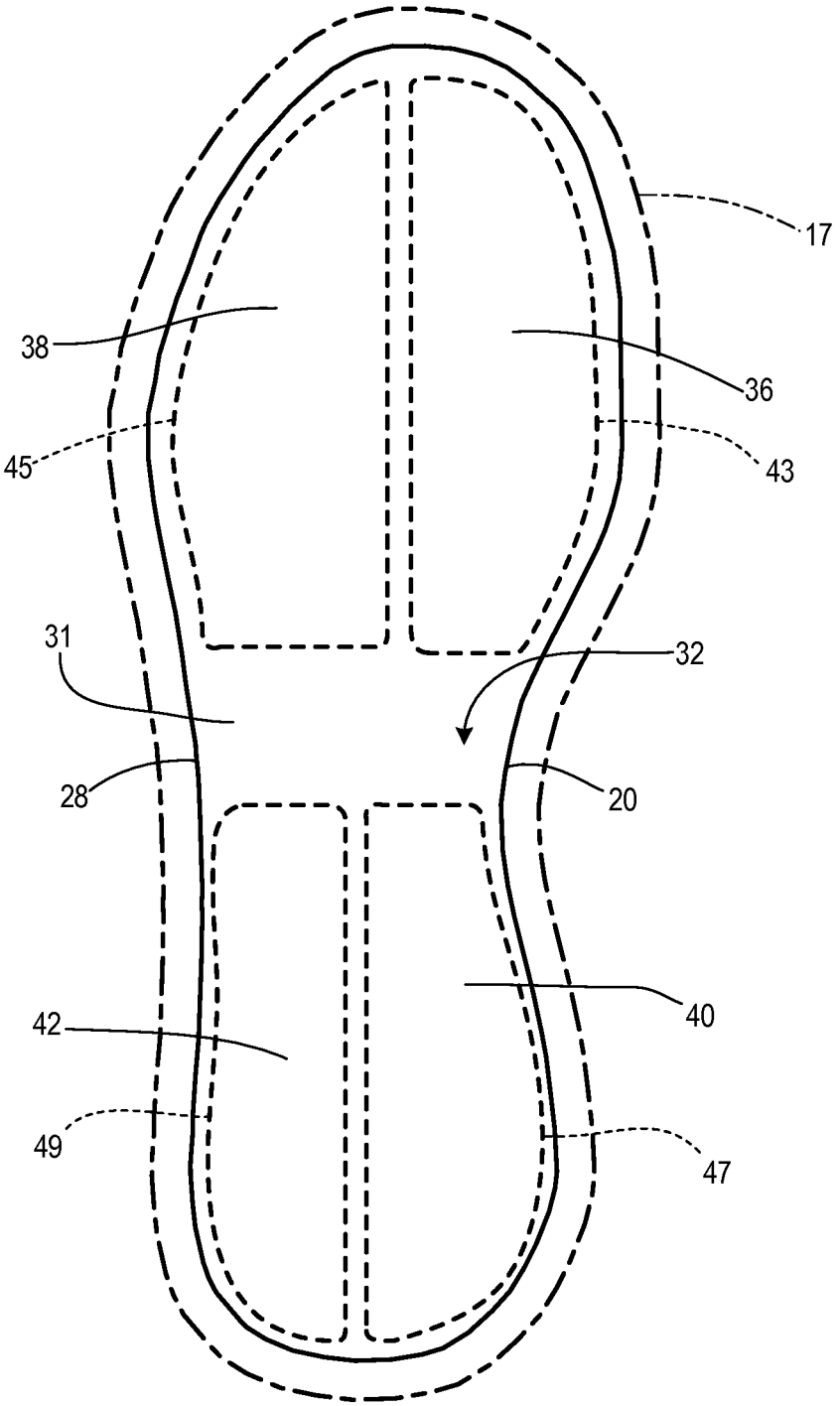
FIG. 3B is a bottom view of the electrically controllable damping pad from the shoe of FIG. 1.

Damping pad 20 includes a chamber 28 having top and bottom walls that are joined around a peripheral edge to form a fluid-tight internal volume. An outer surface 30 of a top wall 29 of chamber 28 is shown in FIG. 3A. Outer surface 30 faces toward the interior of shoe 10. An outer surface 32 of a bottom wall 31 of chamber 28 is shown in FIG. 3B. Outer surface 32 faces toward outsole 16. Top wall 29 and bottom wall 31 may be formed from a flexible polymer material such as a relatively soft TPU (thermoplastic polyurethane).

As mentioned above, damping pad 20 includes electrodes that are positioned to create electrical fields in zones of damping pad 20. Locations of those electrodes and of corresponding zones are indicated with even broken lines in FIGS. 3A and 3B. A top medial forefoot electrode 35 is located on an inner surface of top wall 29, as described in more detail below. Electrode 35 is located over bottom medial electrode 43 located on an inner surface of bottom wall 31. The peripheral boundaries of electrodes 35 and 43 define a medial forefoot zone 36. Peripheral boundaries of a top lateral forefoot electrode 37 located on an inner surface of top wall 29 (FIG. 3A) and a bottom lateral forefoot electrode 45 located on an inner surface of bottom wall 31 (FIG. 3B) define a lateral forefoot zone 38. Peripheral boundaries of a top medial heel/midfoot electrode 39 located on an inner surface of top wall 29 (FIG. 3A) and a bottom medial heel/midfoot electrode 47 located on an inner surface of bottom wall 31 (FIG. 3B) define a medial heel/midfoot zone 40. Peripheral boundaries of a top lateral heel/midfoot electrode 41 located on an inner surface of top wall 29 (FIG. 3A) and a bottom lateral heel/midfoot electrode 49 located on an inner surface of bottom wall 31 (FIG. 3B) define a lateral heel/midfoot zone 42.

Figure 3C:
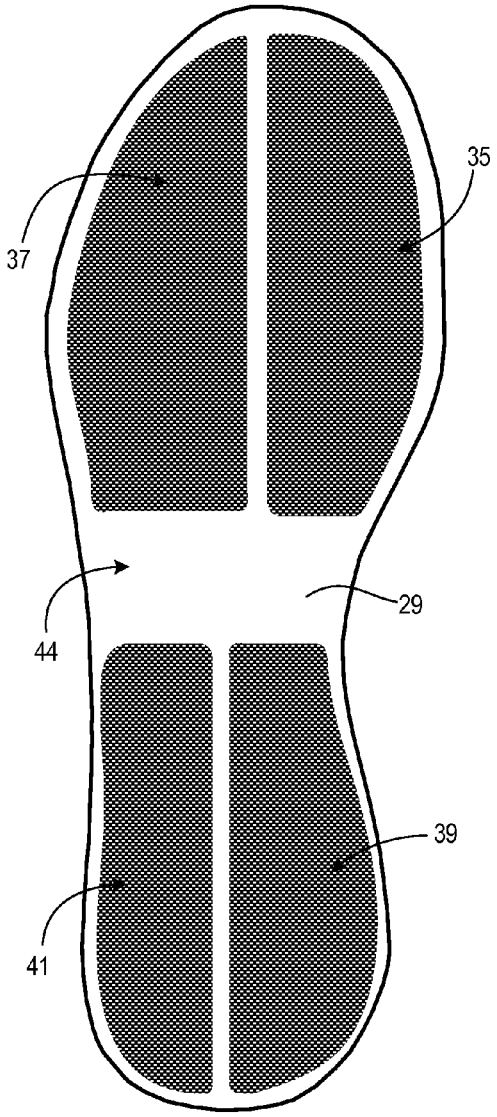
FIG. 3C is bottom view of the top wall of the electrically controllable damping pad from the shoe of FIG. 1.

FIG. 3C is a bottom view of top wall 29 of chamber 28. Electrodes 35, 37, 39, and 41 are formed on inner surface 44 of top wall 29. In some embodiments, electrodes 35, 37, 39, and 41 are patches of conductive ink that have been printed onto inner surface 44. The conductive ink used to form electrodes 35, 37, 39, and 41 may be, e.g., an ink that comprises silver plates in a polymer matrix that includes TPU, and that bonds with the TPU of top wall 29 to form a flexible conductive layer. One example of such an ink is PE872 stretchable conductor available from E.I. DuPont De Nemours and Company.

Figure 3D:
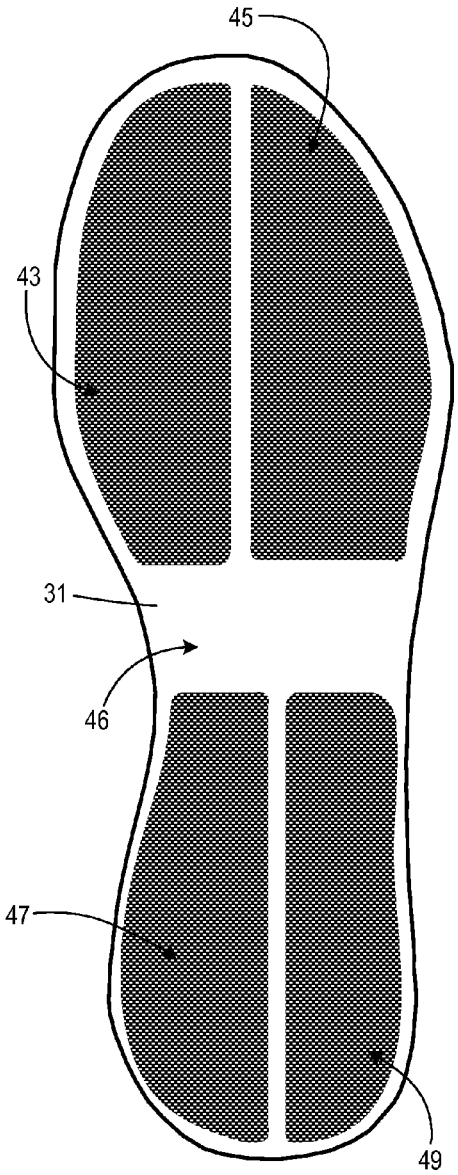
FIG. 3D is top view of the bottom wall of the electrically controllable damping pad from the shoe of FIG. 1.

FIG. 3D is a top view of bottom wall 31 of chamber 28. Electrodes 43, 45, 47, and 49 are formed on inner surface 46 of bottom wall 31. In some embodiments, electrodes 43, 45, 47, and 49 are patches of conductive ink that have been printed onto inner surface 46. The conductive ink used to form electrodes 43, 45, 47, and 49 may be the same type of ink used to form electrodes 35, 37, 39, and 41.

In some embodiments, some or all of electrodes 35, 37, 39, 41, 43, 45, 47, and 49 may be cut from a piece of a stretchable conductive fabric. Such fabrics are commercially available and may, e.g., be knit fabrics that comprise silver-coated Nylon thread. An electrode formed from stretchable conductive fabric may be bonded to inner surface 44 or inner surface 46 using a hot-melt adhesive or in another manner.

Although not shown in the drawings, electrical wires connect electrodes 35, 37, 39, and 41 and electrodes 43, 45, 47, and 49 to a controller. That controller, described below, selectively applies high voltage across pairs of electrodes corresponding to one or more zones. Connections between those wires and the electrodes can be formed in various manners. In some embodiments, for example, each of the electrodes may be connected to a separate wire that penetrates chamber 28 in a location within the boundary of that electrode. Those penetrations may be sealed to prevent escape of ER within chamber 28.

Figure 4A:
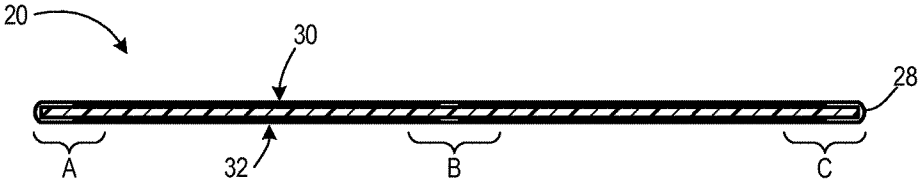
FIG. 4A is an area cross-sectional view taken from the location indicated in FIG. 3A.
Figure 4B:
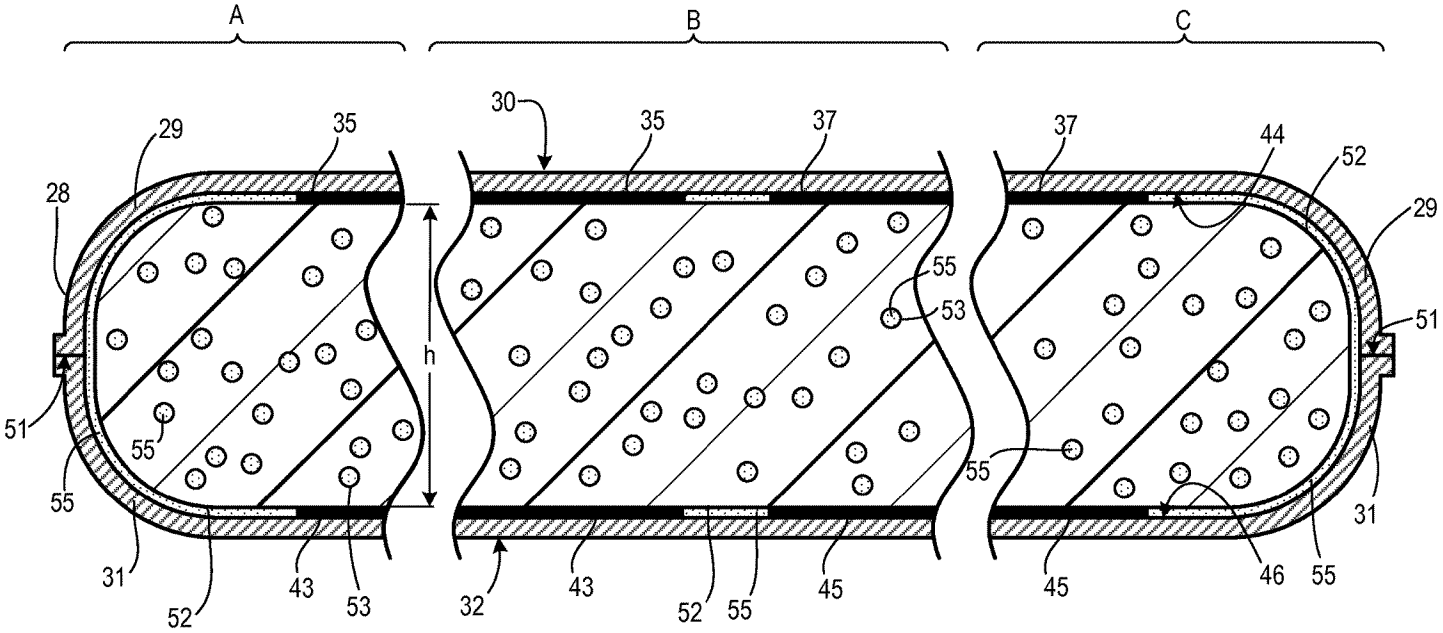
FIG. 4B is an enlargement of portions of the area cross-sectional view of FIG. 4A.

FIG. 4A is an area cross-sectional view of a forefoot region of damping pad 20 taken from the location indicated in FIG. 3A. FIG. 4B is an enlargement of portions of the area cross-sectional of FIG. 4A. The portion of damping pad 20 indicated by letter "A" in FIG. 4B corresponds to the portion indicated with letter "A" in FIG. 4A. Similarly, the portions of damping pad 20 indicated by letters "B" and "C" in FIG. 4B respectively correspond to the portions indicated with letters "B" and "C" in FIG. 4A. In FIG. 4B, pairs of irregular break lines are used to indicate that portions of damping pad 20 are omitted. The structure of the omitted damping pad 20 portion indicated by the break lines between portions A and B in FIG. 4B is the same as the structure in the parts of portions A and B adjacent to those break lines. Similarly, the structure of the omitted damping pad 20 portion indicated by the break lines between portions B and C in FIG. 4B is the same as the structure in the parts of portions B and C adjacent to those break lines. Cross-sections through other regions of damping pad 20 would have a structure similar to that shown by FIG. 4B.

Top wall 29 and bottom wall 31 are joined at an outer peripheral seam 51 to form a sealed chamber 28. Located within a fluid-tight internal volume of chamber 28 is a foam element 52 that extends throughout that internal volume. Foam element 52 is an open cell polymer foam having numerous interconnected small cavities 53. Foam element 52 is represented schematically in FIG. 4B, and no attempt is made to show all cavities 53, the actual sizes of cavities 53, or the interconnected nature of cavities 53. In at least some embodiments, foam element 52 may be formed from an open cell polyurethane foam having a density in a range of about 1.5 pounds per cubic foot ($lbs/ft^3$) to about 1.6 $lbs/ft^3$. Advantages of polyurethane foam include good resilience and absorbency. In some embodiments, a foam element may be formed from a closed cell foam such as EVA, and into which small holes have been formed by a laser. The laser pattern forming those holes may create a tortuous path. In some embodiments, foam element 52 may have a height h of, e.g., between 1 millimeter (mm) and 3 mm. In other embodiments, a foam element within a damping pad have a height less than 1 mm or greater than 3 mm.

The internal volume of chamber 28 also includes an ER fluid 55. In FIG. 4B, ER fluid 55 is represented by coarse stippling. ER fluid 55 permeates foam element 52. In particular, cavities 53 are filled with ER fluid 55. ER fluid 55 also fills spaces between foam element 52 and inner surface 44 of top wall 29, as well as spaces between foam element 52 and inner surface 46 of bottom wall 31. Electrodes 35, 37, 43, and 45, as well as other electrodes of damping pad 20, may be in contact with foam element 52. One example of an ER fluid that may be used in some embodiments is sold under the name "RheOil 4.0" by ERF Produktion Würzberg GmbH.

A zone of damping pad 20 is activated when an activation voltage $V_{act}$ is applied across the upper and lower electrodes corresponding to that zone. When a zone is activated, the compressibility of foam element 52 in that activated zone is reduced. A compressibility reduction may be full or partial. When compressibility is fully reduced in a zone, that zone of damping pad 20 may not noticeably compress under loads resulting from weight of a shoe 10 wearer during walking or running. When compressibility is partially reduced in a zone, that zone of damping pad 20 may still be noticeably compressible under loads resulting from weight of a shoe 10 wearer during walking or running, but the time to compress under a given load is increased (and the zone thus feels more firm) because of higher viscosity of ER fluid 55 within that zone. Higher magnitudes of activation voltage $V_{act}$ result in greater compressibility reduction. One example of an activation voltage $V_{act}$ to achieve full or nearly full reduction of compressibility is a voltage sufficient to create an electric field having a field strength of between 1 kilovolts per millimeter (kV/mm) and 4 kV/mm in a zone. In some embodiments, one or more zones may activatable at one of multiple levels, with each activation level corresponding to a different amount of compressibility reduction.

Figure 5A:
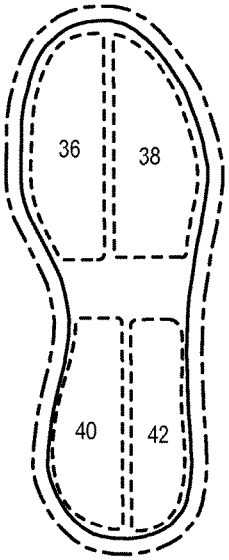
FIGS. 5A through 5P are diagrams showing various combinations of activated and non-activated zones.
Figure 5B:
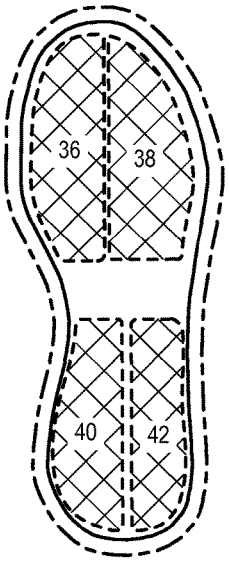

None, some or all of zones 36, 38, 40, and 42 can be activated. FIGS. 5A through 5P are diagrams showing various combinations of activated and non-activated zones. In FIGS. 5A through 5P, cross-hatching indicates an activated zone and the absence of cross-hatching indicates a non-activated zone. In FIG. 5A, none of zones 36, 38, 40, or 42 is activated. In FIG. 5B, all zones are activated. In particular, an activation voltage $V_{act}$ is applied across top medial forefoot electrode 35 and bottom medial forefoot electrode 43 to activate zone 36, an activation voltage $V_{act}$ is applied across top lateral forefoot electrode 37 and bottom lateral forefoot electrode 45 to activate zone 38, an activation voltage $V_{act}$ is applied across top medial heel/midfoot electrode 39 and bottom medial heel/midfoot electrode 47 to activate zone 40, and an activation voltage $V_{act}$ is applied across top lateral heel/midfoot electrode 41 and bottom lateral heel/midfoot electrode 49 to activate zone 42. The magnitude of the activation voltage $V_{act}$ need not be the same in each zone.

Figure 5C:
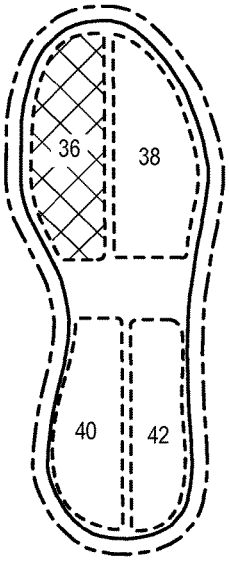
Figure 5D:
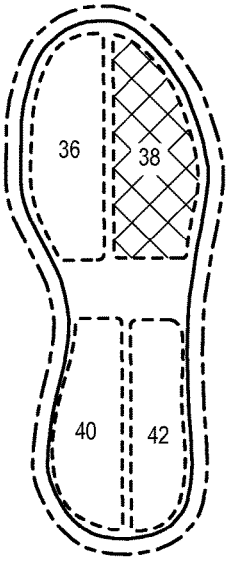
Figure 5E:
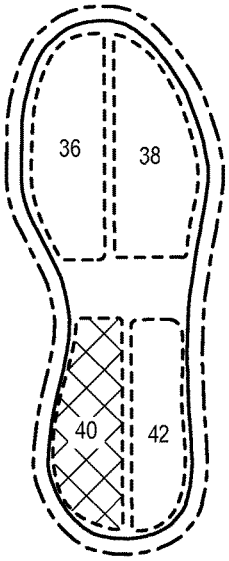
Figure 5F:
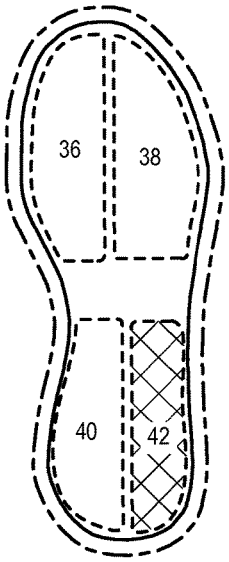

In FIG. 5C, only zone 36 is activated, i.e., an activation voltage $V_{act}$ is only applied across top medial forefoot electrode 35 and bottom medial forefoot electrode 43. In FIG. 5D, only zone 38 is activated, i.e., an activation voltage $V_{act}$ is only applied across top lateral forefoot electrode 37 and bottom lateral forefoot electrode 45. In FIG. 5E, only zone 40 is activated, i.e., an activation voltage $V_{act}$ is only applied across top medial heel/midfoot electrode 39 and bottom medial heel/midfoot electrode 47. In FIG. 5F, only zone 42 is activated, i.e., an activation voltage $V_{act}$ is only applied across top lateral heel/midfoot electrode 41 and bottom lateral heel/midfoot electrode 49.

Figure 5G:
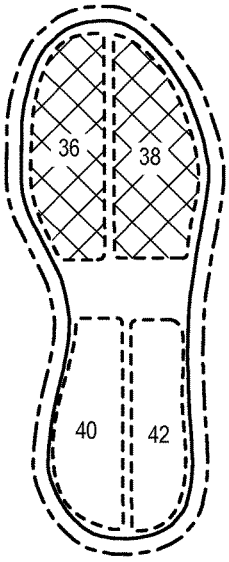
Figure 5H:
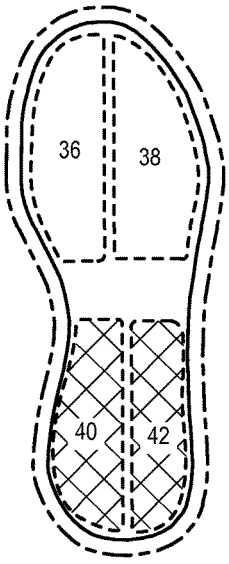
Figure 5I:
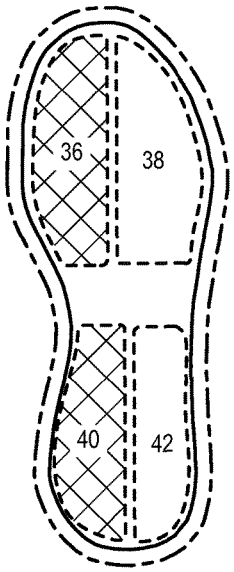
Figure 5J:
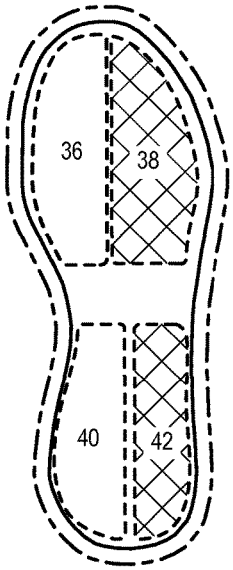
Figure 5K:
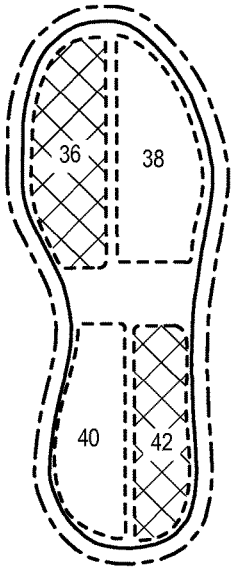
Figure 5L:
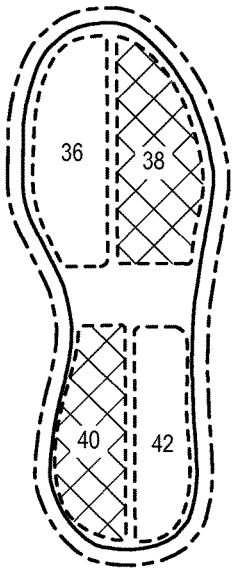
Figure 5M:
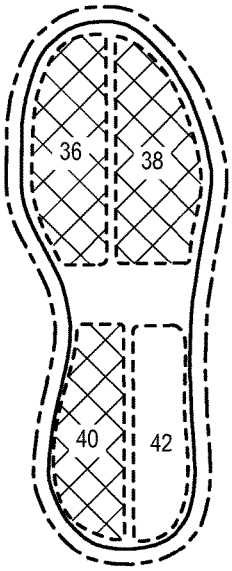
Figure 5N:
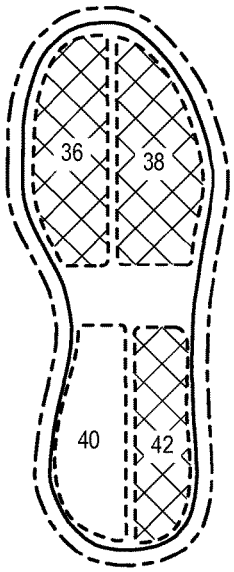
Figure 5O:
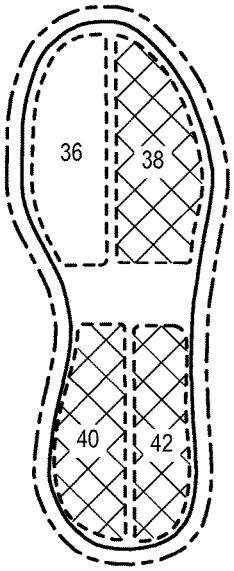
Figure 5P:
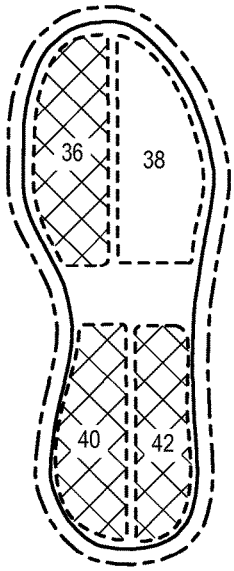

FIGS. 5G through 5P show various scenarios in which more than one, but less than all, of zones 36, 38, 40, and 42 are activated. In FIG. 5G, zones 36 and 38 are activated and zones 40 and 42 are not activated. In FIG. 5H, zones 36 and 38 are not activated and zones 40 and 42 are activated. In FIG. 5I, zones 36 and 40 are activated and zones 38 and 42 are not activated. In FIG. 5J, zones 38 and 42 are activated and zones 36 and 40 are not activated. In FIG. 5K, zones 36 and 42 are activated and zones 38 and 40 are not activated. In FIG. 5L, zones 38 and 40 are activated and zones 36 and 42 are not activated. FIGS. 5M through 5P respectively show scenarios in which all zones except zone 42 are activated, all zones except zone 40 are activated, all zones except zone 36 are activated, and all zones except zone 38 are activated.

Figure 6:
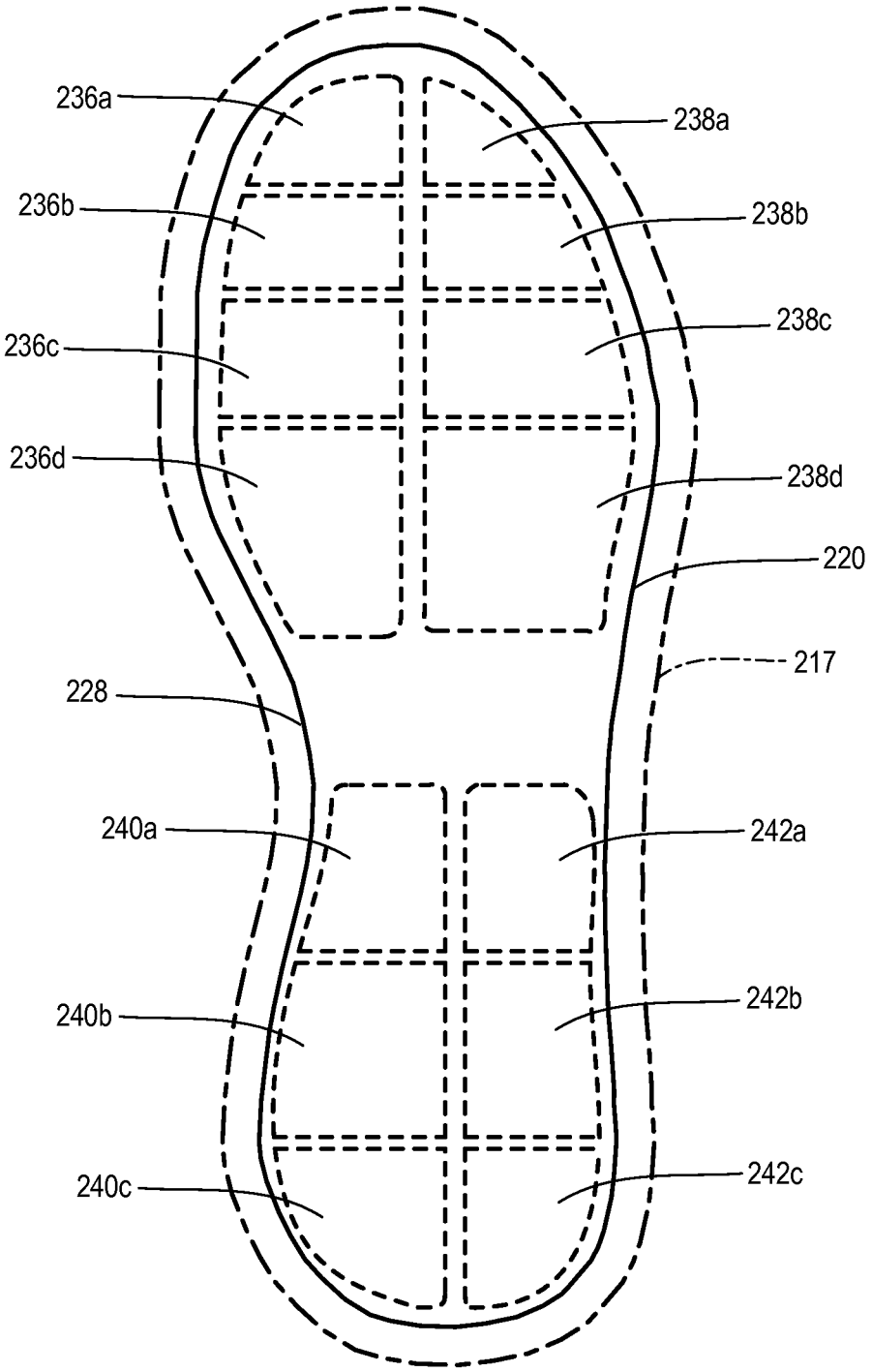
FIG. 6 is a top view of an electrically controllable damping pad according to additional embodiments.

In some embodiments, a damping pad may have more or less zones, and/or the zones may be configured differently from the way in which zones 36, 38, 40, and 42 are configured. For example, FIG. 6 is a top view of a damping pad 220 according to another embodiment. Damping pad 220 includes a chamber 228 having an outer shape similar to that of damping pad 20 and positioned within a midsole 217 of a sole structure of a shoe in a manner similar that in which damping pad 20 is positioned within midsole 17 of shoe 10. Damping pad 228 may include a foam element similar to foam element 52. Unlike damping pad 20, however, damping pad 220 has additional zones that may be selectively activated to increase firmness. Instead of a single medial forefoot zone and a single lateral forefoot zone, damping pad 228 includes four medial forefoot zones 236*a* through 236*d* and four lateral forefoot zones 238*a* through 238*d*. Instead of a single medial heel/midfoot zone and a single lateral heel/midfoot zone, damping pad 220 includes three medial heel/midfoot zones 240*a* through 204*c* and three lateral heel/midfoot zones 242*a* through 242*c*. Each of zones 236*a*-236*d*, 238*a*-238*d*, 240*a*-240*c*, and 242*a*-242*c* may correspond to an upper and a lower electrode having the shape of the corresponding zone and positioned on inner walls of chamber 228 in a manner similar to the electrodes of damping element 20. Zones 236*a*-236*d*, 238*a*-238*d*, 240*a*-240*c*, and 242*a*-242*c* may be activated in any combination, which activation may result in full or partial compressibility reduction.

Figure 7:
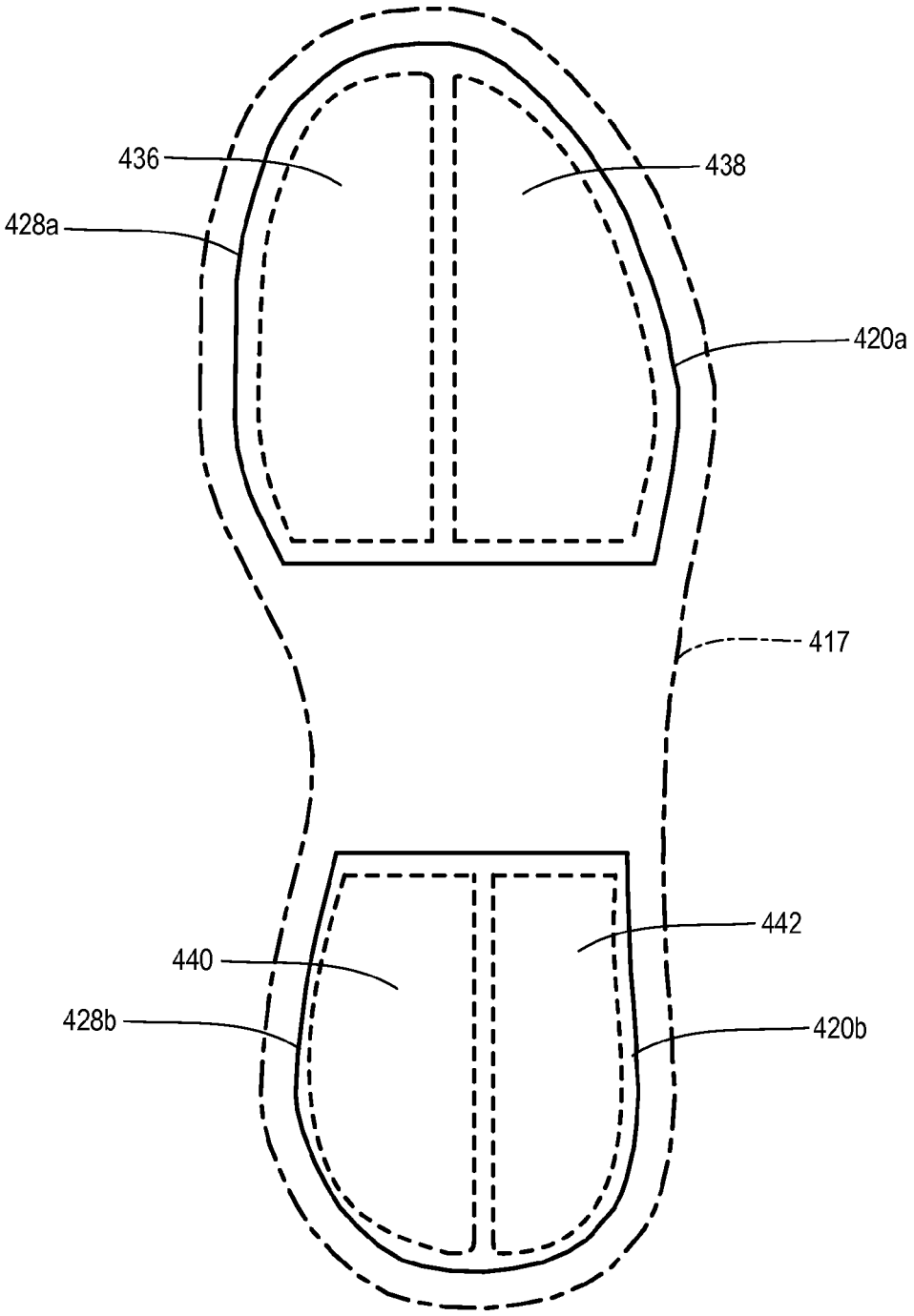
FIG. 7 is a top view of electrically controllable damping pads according to additional embodiments.

In some embodiments, a sole structure may include more than one damping pad. For example, FIG. 7 is a top view of damping pads 420*a* and 420*b* according to another embodiment. Damping pad 420*a* includes a chamber 428*a* having an outer shape similar to that of a forefoot portion of damping pad 20 and is positioned within a midsole 417 of a sole structure of a shoe in a manner similar that in which that forefoot portion of damping pad 20 is positioned within midsole 17 of shoe 10. Damping pad 420*b* includes a chamber 428*b* having an outer shape similar to that of a heel portion of damping pad 20 and positioned within midsole 417 in a manner similar that in which that heel portion of damping pad 20 is positioned within midsole 17. Damping pads 428*a* and 428*b* may include foam elements similar to portions of foam element 52 located in forefoot and heel portions of damping pad 20. Damping pad 428*a* includes a medial forefoot zone 436 and a lateral forefoot zone 438. Damping pad 428*b* includes a medial heel zone 440 and a lateral heel zone 442. Each of zones 436, 438, 440, and 442 may correspond to an upper and a lower electrode having the shape of the corresponding zone and positioned on inner walls of chamber 428*a* or 428*b* in a manner similar to the electrodes of damping element 20. Zones 436, 438, 440, and 442 may be activated in any combination, which activation may result in full or partial compressibility.

Figure 8:
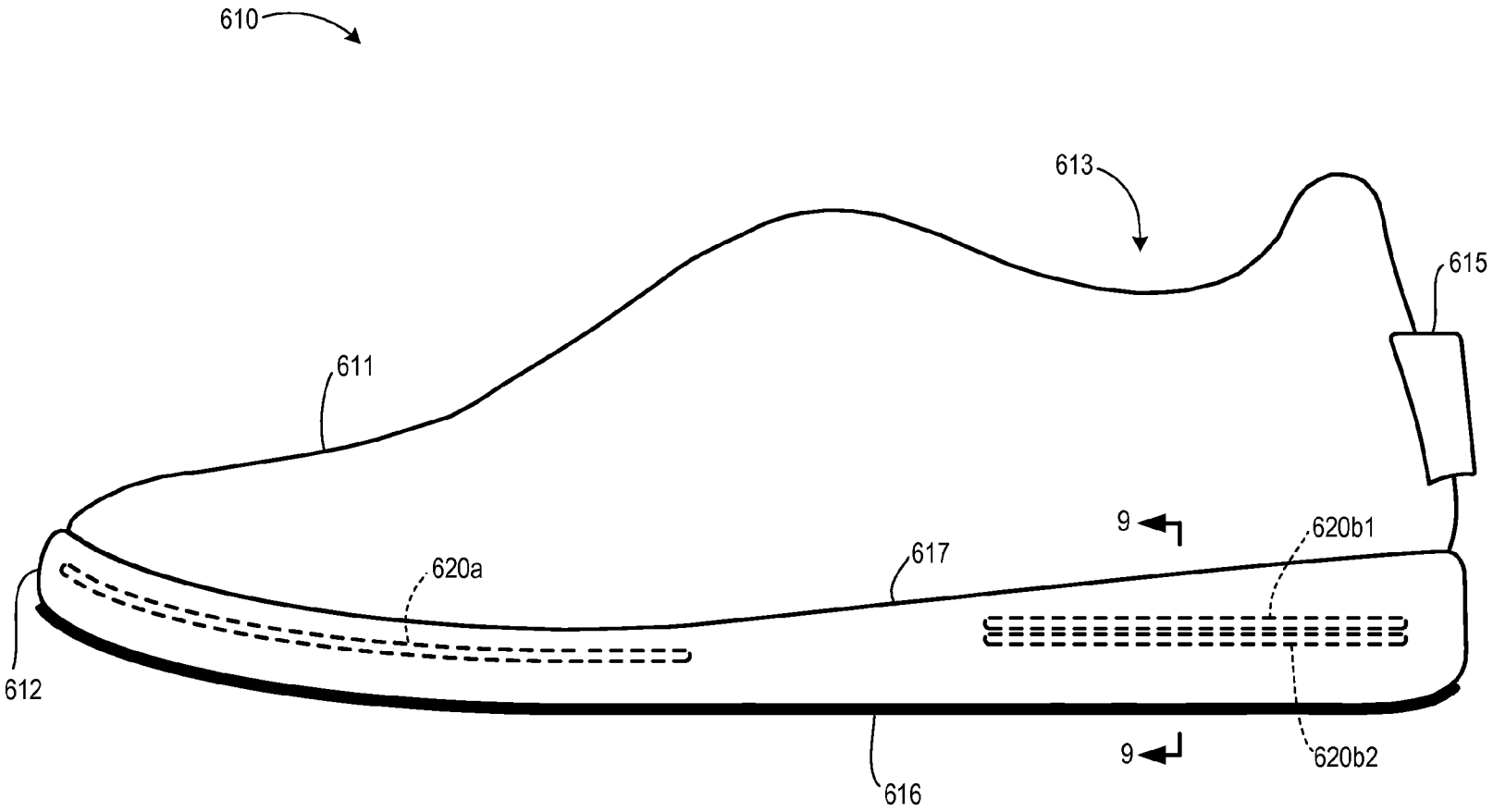
FIG. 8 is a medial side view of a shoe according to additional embodiments.
Figure 9:
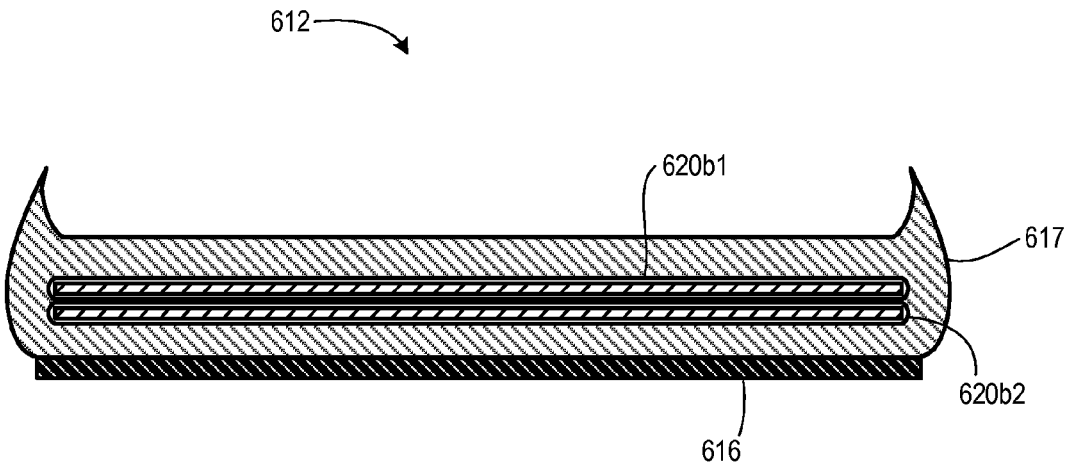
FIG. 9 is an area cross-sectional view taken from the location indicated in FIG. 8.

In some embodiments, damping pads may be stacked within a sole structure. For example, FIG. 8 is a medial side view of a shoe 610 according to some such embodiments. Shoe 610 may include an upper 611, sole structure 612, ankle opening 613, battery pack 615, outsole 616, and midsole 617 that are, except as described below, similar to upper 11, sole structure 12, ankle opening 13, battery pack 15, outsole 16, and midsole 17 of shoe 10 (FIG. 1). Instead of a single damping pad 20, however, sole structure 612 includes a forefoot damping pad 620*a* that is similar to damping pad 420*a* (FIG. 7) and two heel damping pads 620*b*1 and 620*b*2, each of which is similar to heel damping pad 420*b*. FIG. 9 is an area cross-sectional view of sole structure 612 taken from the location indicated in FIG. 8. As seen in FIG. 9, damping pads 620*b*1 and 620*b*2 are stacked directly on top of one another. As with previously described embodiments, the zones of damping pad 620*a*, 620*b*1, and 620*b*2 may be activated in any combination, which activation may result in full or partial compressibility reduction. The zones of stacked damping pads may, but need not be, activated in a parallel manner. For example, a lateral heel zone of damping pad 620*b*1 may not be activated when a lateral heel zone of damping pad 620*b*2 is activated.

Figure 10:
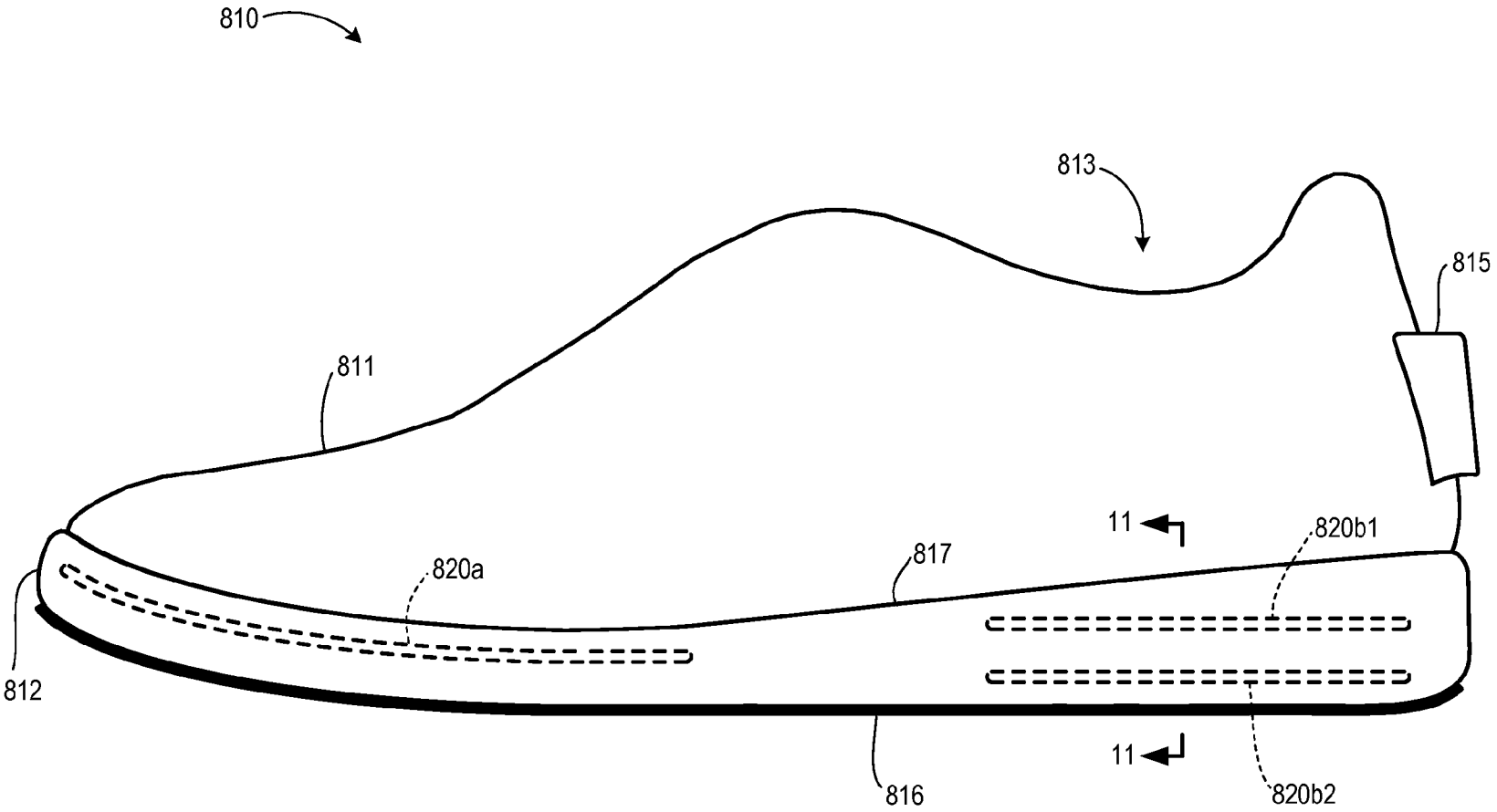
FIG. 10 is a medial side view of a shoe according to additional embodiments.
Figure 11:
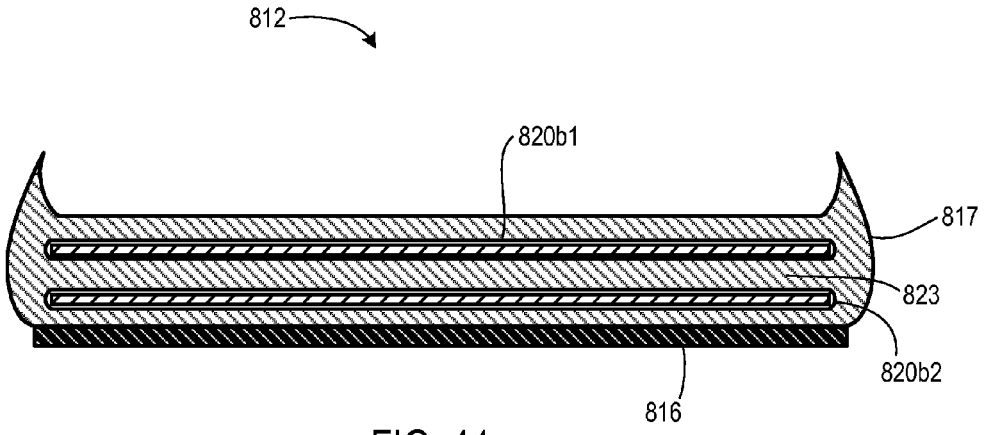
FIG. 11 is an area cross-sectional view taken from the location indicated in FIG. 10.
Figure 12:
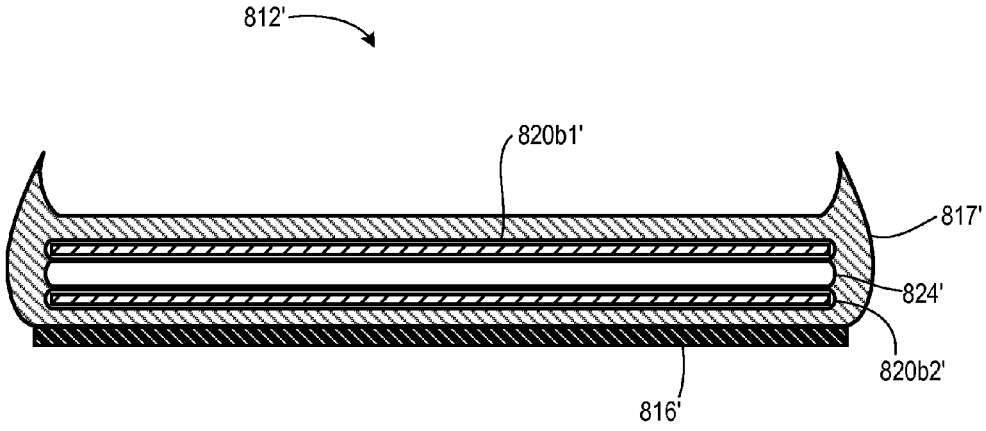
FIG. 12 is an area cross-sectional view of a sole structure according to other embodiments.

FIG. 10 is a medial side view of a shoe 810 according to some additional embodiments. Shoe 810 may include an upper 811, sole structure 812, ankle opening 813, battery pack 815, outsole 816, and midsole 817 that are, except as described below, similar to upper 11, sole structure 12, ankle opening 13, battery pack 15, outsole 16, and midsole 17 of shoe 10 (FIG. 1). Similar to sole structure 612 of shoe 610, sole structure 812 includes a forefoot damping pad 820*a* that is similar to damping pad 420*a* (FIG. 7) and two heel damping pads 820*b*1 and 820*b*2, each of which is similar to heel damping pad 420*b*. As with damping pads 620*b*1 and 620*b*2 of sole structure 612, damping pads 820*b*1 and 820*b*2 are stacked. Unlike damping pads 620*b*1 and 620*b*2, however, damping pads 820*b*1 and 820*b*2 are separated by a cushioning element. As seen in FIG. 11, an area cross-sectional view of sole structure 812 from the location indicated in FIG. 10, an intermediate layer of compressible foam 823 is located between damping pads 820*b*1 and 820*b*2. In other embodiments, another type of cushioning element may be placed between 820*b*1 and 820*b*2. For example, FIG. 12 is an area cross-sectional view of a sole structure 812' taken from a location similar to that from which the area cross-sectional view of FIG. 11 is taken. Sole structure 812' is similar to sole structure 812 and includes a midsole 817', an outsole 816', and heel damping pads 820*b*1' and 820*b*2' that are respectively similar to midsole 817, outsole 816, and heel damping pads 820*b*1 and 820*b*2. In sole structure 812', however, a fluid-filled bladder 824' is positioned between damping pads 820*b*1' and 820*b*2'. In other embodiments, one or more other types of cushioning elements may replace bladder 824' (e.g., a piece of foam having properties different from foam used in other portions of midsole 817'). In yet other embodiments, bladder 824' may be replaced with or supplemented by a non-cushioning element (e.g., a support plate).

The arrangements of multiple damping pads within a sole structure described above merely represent some example embodiments. In other embodiments, for example, more than two damping pads may be stacked. As another example, stacked damping pads may also or alternatively be located in forefoot and/or midfoot regions. Stacked damping pads need not be precisely aligned in the vertical direction and/or need not have the same shape.

The shapes and arrangements of zones within damping pads described above also merely represent some example embodiments. In some other embodiments, for example, damping pad zones need not be divided by a generally centered longitudinal axis or by straight transverse axes. The zones in a first damping pad need not have the same configuration as zones in a second damping pad over which that first damping pad is stacked.

Figure 13:
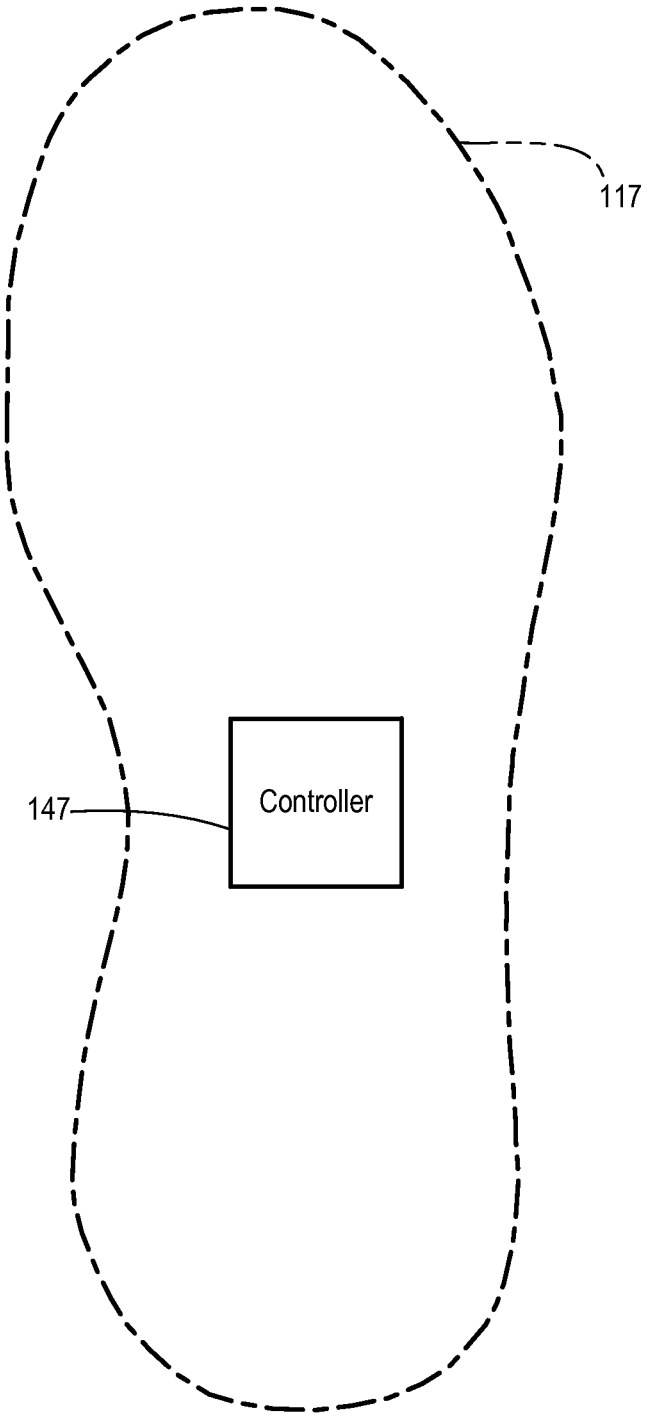
FIG. 13 is a partially schematic diagram showing a location of a controller in a midsole.

In some embodiments, a controller may include electronics that selectively apply voltages to electrodes within one or more damping pads so as to activate one or more zones. A controller may include one or more printed circuit boards and one or more DC to high voltage DC converters and may be located in a midsole. FIG. 13 is a partially schematic top view diagram showing a location of a controller 147 in a midsole 117. Midsole 117 could be in a sole structure similar to any of the sole structures described above or may be part of a sole structure according to other embodiments. As seen in FIG. 13, controller 147 may be located in a midfoot region. If a damping pad is also located in the midfoot region, controller 147 could be located above or below that damping pad. A controller need not be located within a sole structure. In some embodiments, for example, some or all components of a controller could be located within the housing of a battery assembly such as battery assembly 15 and/or in another housing positioned on a footwear upper.

Figure 14:
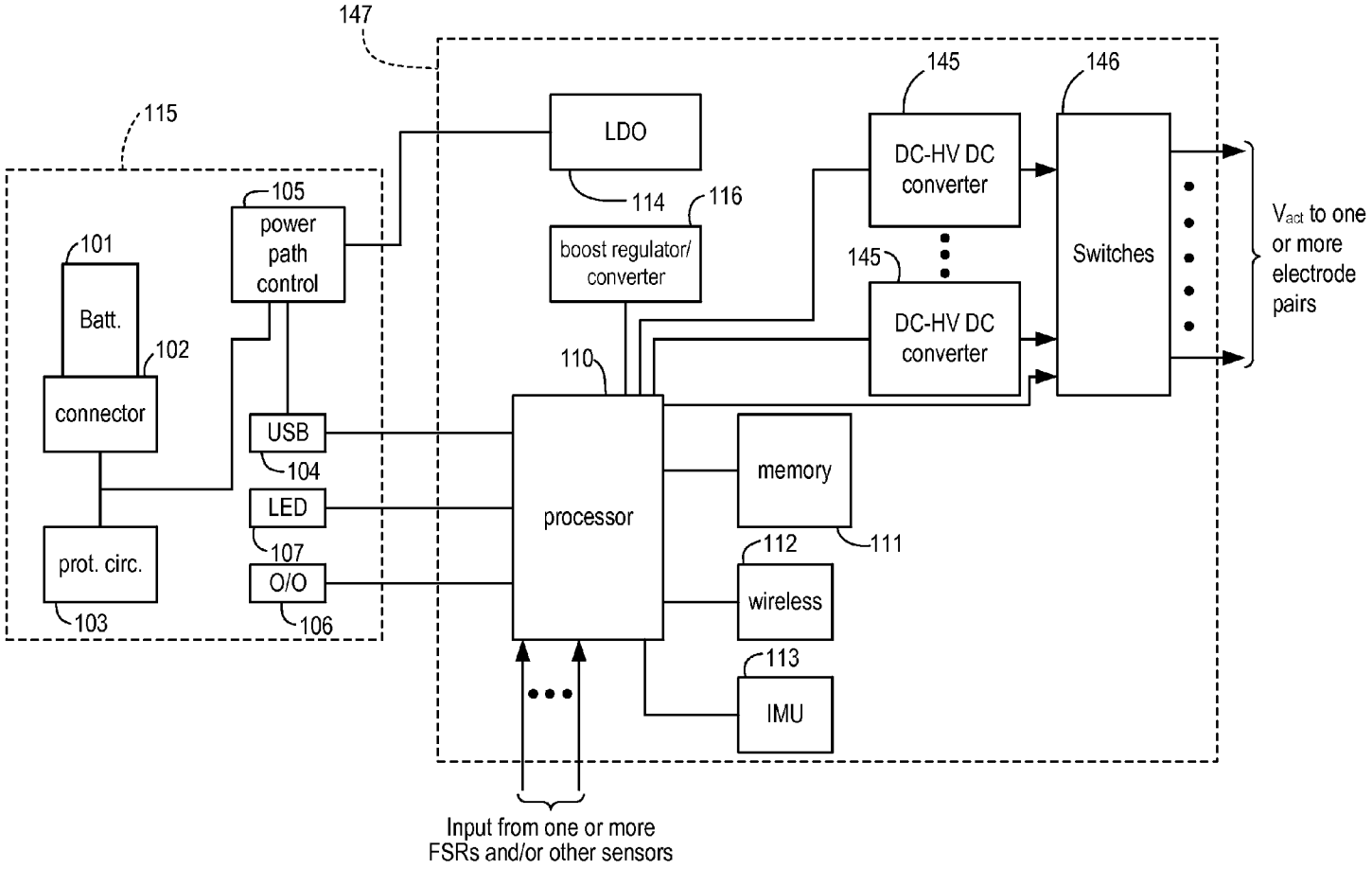
FIG. 14 is a block diagram showing electrical system components in shoes according to at least some embodiments.

FIG. 14 is a block diagram showing electrical system components in shoes according to at least some embodiments, including the embodiments described above. Individual lines to or from blocks in FIG. 14 represent signal (e.g., data and/or power) flow paths and are not necessarily intended to represent individual conductors. Battery pack 115, which may be similar to any of battery packs 15 (FIG. 1), 615 (FIG. 8) or 815 (FIG. 10), includes a rechargeable lithium ion battery 101, a battery connector 102, and a lithium ion battery protection IC (integrated circuit) 103. Protection IC 103 detects abnormal charging and discharging conditions, controls charging of battery 101, and performs other conventional battery protection circuit operations. Battery pack 115 also includes a USB (universal serial bus) port 104 for communication with controller 147 and for charging battery 101. A power path control unit 105 controls whether power is supplied to controller 147 from USB port 104 or from battery 101. An ON/OFF (O/O) button 106 activates or deactivates controller 147 and battery pack 115. An LED (light emitting diode) 107 indicates whether the electrical system is ON or OFF. The above-described individual elements of battery pack 115 may be conventional and commercially available components that are combined and used in the novel and inventive ways described herein.

Controller 147 includes components that may be located on a single PCB or that may be packaged in some other manner. Controller 147 includes a processor 110, a memory 111, an inertial measurement unit (IMU) 113, and a low energy wireless communication module 112 (e.g., a BLUETOOTH communication module). Memory 111 stores instructions that may be executed by processor 110 and may store other data. Processor 110 executes instructions stored by memory 111 and/or stored in processor 110, which execution results in controller 147 performing operations such as are described herein. As used herein, instructions may include hard-coded instructions and/or programmable instructions.

Data stored in memory 111 and/or processor 110 may include one or more look-up tables that define levels of activation voltage $V_{act}$ for each of multiple levels of compressibility reduction in each of multiple zones of one or more damping pads. That data may also include configuration profiles, each of which corresponds to a different combination of zone activations. Upon receiving user input (e.g., via USB port 104 or wireless communication module 112) selecting one of those profiles, processor 110 may activate zones as defined by that selected profile.

IMU 113 may include a gyroscope and an accelerometer and/or a magnetometer. Data output by IMU 113 may be used by processor 110 to detect changes in orientation and motion of a shoe containing controller 147, and thus of a foot wearing that shoe. Processor 110 may use such information to determine when to activate or deactivate particular zones. For example, controller 110 may determine that a foot is on the ground and rolling from the lateral to the medial side as the wearer progresses through the step portion of the gait cycle. In some embodiments, controller 110 may activate one or more forefoot region zones to provide increased firmness when the shoe wearer foot reaches the toe-off portion of the gait cycle. Wireless communication module 112 may include an ASIC (application specific integrated circuit) and be used to communicate programming and other instructions to processor 110, as well as to download data that may be stored by memory 111 or processor 110.

Controller 147 may include a low-dropout voltage regulator (LDO) 114 and a boost regulator/converter 116. LDO 114 receives power from battery pack 115 and outputs a constant voltage to processor 110, memory 111, wireless communication module 112, and IMU 113. Boost regulator/converter 116 boosts a voltage from battery pack 115 to a level (e.g., 5 volts) that provides an acceptable input voltage to DC to HV DC converter(s) 145. Converter(s) 145 then increase(s) that voltage to a much higher level (e.g., 5000 volts). Processor 110 then controls application of the high voltage DC output from converter(s) 145 to electrodes of one or more zones in one or more damping pads by sending control signals to a switch array 146. Boost regulator/converter 116 and converter(s) 145 are also enabled and disabled by signals from processor 110.

Controller 147 may also receive signals from one or more force sensitive resistors (FSR) and/or other sensors located within the sole structure that includes controller 147. Those signals may indicate forces in regions where the FSRs and/or other sensors are located and be used as additional data by processor 110 to determine, e.g., when a foot is no longer stepping on the ground.

The above-described individual elements of controller 147 may be conventional and commercially available components that are combined and used in the novel and inventive ways described herein. Moreover, controller 147 may be physically configured, by instructions stored in memory 111 and/or processor 110, to perform the herein described novel and inventive operations.

In embodiments described above, a damping pad is located within a sole structure that includes additional cushioning elements above and below the damping pad. In some embodiments, a sole structure may lack additional cushioning elements above and/or below a damping pad. For example, a damping pad may be in direct contact with an outsole or with a strobel or other lasting element. In some embodiments, some or all portions of a sole structure may lack other cushioning elements in some or all regions in which one or more damping pads are located.

Figure 15:
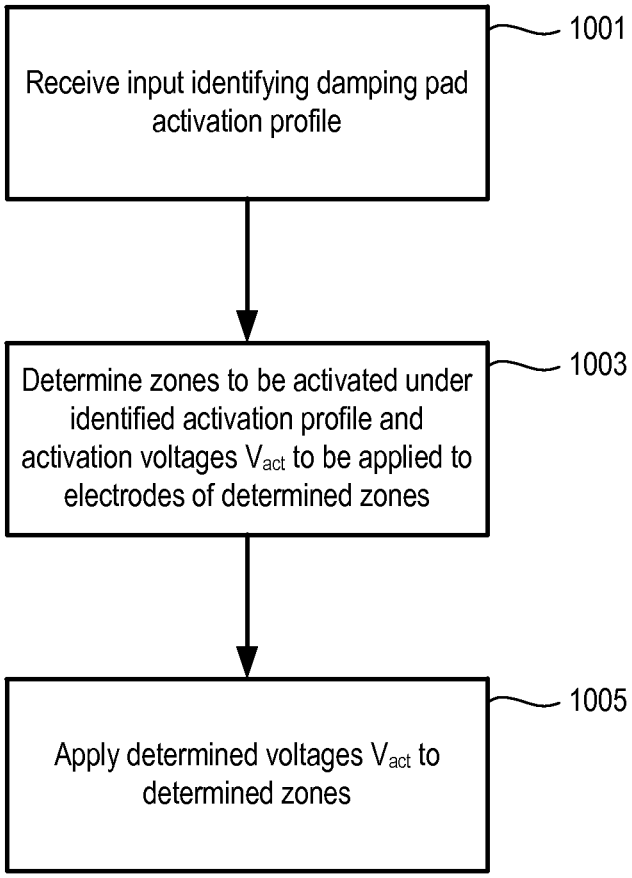
FIG. 15 is a flow chart showing operations performed by a controller according to some embodiments.

FIG. 15 is a flow chart showing operations performed by controller 147 according to some embodiments. In a first step 1001, controller 147 receives input identifying a damping pad activation profile. For example, each of the combinations shown in FIGS. 5B through 5P could correspond to a different activation profile. In a second step 1003, controller 147 determines the zones that are to be activated under the identified activation profile and the activation voltage $V_{act}$ to be applied to the electrodes of each of the determined zones. Those activation voltages may be different for one or more determined zones. For example, the identified profile may specify activation of one or more zones to achieve a first amount of compressibility reduction and activation of one or more zones to achieve a second amount of compressibility reduction different from the first amount of compressibility reduction. In a third step 1005, controller 147 applies the determined voltages to the identified zones.

The foregoing description of embodiments has been presented for purposes of illustration and description. The foregoing description is not intended to be exhaustive or to limit embodiments of the present invention to the precise form disclosed, and modifications and variations are possible in light of the above teachings or may be acquired from practice of various embodiments. The embodiments discussed herein were chosen and described in order to explain the principles and the nature of various embodiments and their practical application to enable one skilled in the art to utilize the present invention in various embodiments and with various modifications as are suited to the particular use contemplated. Any and all combinations, subcombinations and permutations of features from herein-described embodiments are the within the scope of the invention. In the claims, a reference to a potential or intended wearer or a user of a component does not require actual wearing or using of the component or the presence of the wearer or user as part of the claimed invention.

For the avoidance of doubt, the present application includes the subject-matter described in the following numbered paragraphs (referred to as "Para" or "Paras"):

1. An article of footwear comprising an upper and a sole structure coupled to the upper and including a first electrically controllable damping pad positioned in a plantar region of the sole structure, wherein the first damping pad includes a first chamber, a first foam element located within the first chamber, a first electrorheological fluid located within the first chamber and at least partially permeating the first foam element, and a set of first electrodes positioned to create, in response to a voltage across the first electrodes, an electrical field in at least a portion of the first electrorheological fluid.
2. The article of footwear of Para 1, wherein the sole structure further comprises an electrically controllable second damping pad positioned in the plantar region of the sole structure and above the first damping pad, wherein the second damping pad includes a second chamber, a second foam element located within the second chamber, a second electrorheological fluid located within the second chamber and at least partially permeating the second foam element, and a set of second electrodes positioned to create, in response to a voltage across the second electrodes, an electrical field in at least a portion of the second electrorheological fluid.

3. The article of footwear of Para 2, wherein the second damping pad is directly adjacent to the first damping pad.
4. The article of footwear of Para 2, wherein the sole structure comprises a cushioning element positioned between the first damping pad and the second damping pad.
5. The article of footwear of Para 4, wherein the cushioning element is one of a compressible polymer foam element and a fluid-filled bladder.
6. The article of footwear of any of the preceding Paras, wherein the first damping pad comprises a first zone and a second zone, wherein the first zone and the second zone are not coterminous, and wherein the first electrodes comprise a first subset of the first electrodes positioned in and defining the first zone, and a second subset of the first electrodes positioned in and defining the second zone.
7. The article of footwear of Para 6, wherein the first zone is substantially limited to a lateral side of the first damping pad and the second zone is substantially limited to a medial side of the first damping pad.
8. The article of footwear of Para 6, wherein the first zone is substantially limited to a forward end of the first damping pad and the second zone is substantially limited to a rear end of the first damping pad.
9. The article of footwear of any of Paras 6 to 8, wherein the first damping pad comprises a third zone and a fourth zone, wherein none of the first, second, third, or fourth zones is conterminous with any of the other first damping pad zones, and wherein the first electrodes comprise a third subset of the first electrodes positioned in and defining the third zone, and a fourth subset of the first electrodes positioned in and defining the fourth zone.
10. The article of footwear of Para 9, wherein the first zone is substantially limited to a lateral side and a forward end of the first damping pad, the second zone is substantially limited to a medial side and the forward end of the first damping pad, the third zone is substantially limited to the lateral side and a rear end of the first damping pad, and the fourth zone is substantially limited to the medial side and the rear end of the first damping pad.
11. The article of footwear of any of the preceding Paras, wherein the first chamber includes at least one wall formed from a flexible polymer.
12. The article of footwear of any of the preceding Paras, wherein the first damping pad is located in a heel region of the sole structure.
13. The article of footwear of any of Paras 1 to 11, wherein the first damping pad is located in a forefoot region of the sole structure.
14. The article of footwear of any of Paras 1 to 11, wherein the first damping pad is located in forefoot and heel regions of the sole structure.
15. The article of footwear of any of the preceding Paras, further comprising a controller including a processor and memory, at least one of the processor and memory storing instructions executable by the processor to perform operations that include receiving input identifying an activation profile, determining zones that are to be activated under the identified activation profile and an activation voltage $V_{act}$ to be applied to electrodes of each of the determined zones, and applying the determined voltages to the identified zones.
16. The article of footwear of Para 15, wherein a portion of the determined zones are zones of the first damping pad and a portion of the determined zones are zones of a second damping pad.
17. A sole structure comprising an outsole and a midsole coupled to the outsole and including a first electrically controllable damping pad positioned in a plantar region of the sole structure, wherein the first damping pad includes a first chamber, a first foam element located within the first chamber, a first electrorheological fluid located within the first chamber and at least partially permeating the first foam element, and a set of first electrodes positioned to create, in response to a voltage across the first electrodes, an electrical field in at least a portion of the first electrorheological fluid.
18. The sole structure of Para 17, wherein the sole structure further comprises an electrically controllable second damping pad positioned in the plantar region of the sole structure and above the first damping pad, wherein the second damping pad includes a second chamber, a second foam element located within the second chamber, a second electrorheological fluid located within the second chamber and at least partially permeating the second foam element, and a set of second electrodes positioned to create, in response to a voltage across the second electrodes, an electrical field in at least a portion of the second electrorheological fluid.
19. The sole structure of Para 18, wherein the second damping pad is directly adjacent to the first damping pad.
20. The sole structure of Para 18, wherein the sole structure comprises a cushioning element positioned between the first damping pad and the second damping pad.
21. The sole structure of Para 20, wherein the cushioning element is one of a compressible polymer foam element and a fluid-filled bladder.
22. The sole structure of any of Paras 17 to 21, wherein the first damping pad comprises a first zone and a second zone, wherein the first zone and the second zone are not coterminous, and wherein the first electrodes comprise a first subset of the first electrodes positioned in and defining the first zone, and a second subset of the first electrodes positioned in and defining the second zone.
23. The sole structure of Para 22, wherein the first zone is substantially limited to a lateral side of the first damping pad and the second zone is substantially limited to a medial side of the first damping pad.
24. The sole structure of Para 22, wherein the first zone is substantially limited to a forward end of the first damping pad and the second zone is substantially limited to a rear end of the first damping pad.
25. The sole structure of any of Paras 22 to 24, wherein the first damping pad comprises a third zone and a fourth zone, wherein none of the first, second, third, or fourth zones is conterminous with any of the other first damping pad zones, and wherein the first electrodes comprise a third subset of the first electrodes positioned in and defining the third zone, and a fourth subset of the first electrodes positioned in and defining the fourth zone.
26. The sole structure of Para 25, wherein the first zone is substantially limited to a lateral side and a forward end of the first damping pad, the second zone is substantially limited to a medial side and the forward end of the first damping pad, the third zone is substantially limited to the lateral side and a rear end of the first damping pad, and the fourth zone is substantially limited to the medial side and the rear end of the first damping pad.

27. The sole structure of any of Paras 17 to 26, wherein the first damping pad is located in a heel region of the sole structure.

28. The sole structure of any of Paras 17 to 26, wherein the first damping pad is located in a forefoot region of the sole structure.

29. The sole structure of any of Paras 17 to 26, wherein the first damping pad is located in forefoot and heel regions of the sole structure.

30. The sole structure of any of Paras 17 to 29, wherein the sole structure further comprises a controller including a processor and memory, at least one of the processor and memory storing instructions executable by the processor to perform operations that include receiving input identifying an activation profile, determining zones that are to be activated under the identified activation profile and an activation voltage $V_{act}$ to be applied to electrodes of each of the determined zones, and applying the determined voltages to the identified zones.

The invention claimed is:

1. An article of footwear comprising:

an upper; and a sole structure coupled to the upper and including a first electrically controllable damping pad positioned in a plantar region of the sole structure, wherein the first damping pad includes a first chamber, a first foam element located within the first chamber, a first electrorheological fluid located within the first chamber and at least partially permeating the first foam element, and a set of first electrodes comprising a first subset and a second subset, each electrode of the first subset and second subset of first electrodes comprising a peripheral boundary, the peripheral boundaries of the first subset positioned in and defining a first compressibility zone of the first chamber between the first subset of first electrodes and spaced inwardly of a peripheral boundary of the first chamber, the peripheral boundaries of the second subset positioned in and defining a second compressibility zone of the first chamber between the second subset of first electrodes and spaced inwardly of a peripheral boundary of the first chamber, wherein the first compressibility zone and the second compressibility zone are not coterminous, the first subset of first electrodes positioned to create, in response to a voltage across the first subset of first electrodes, an electrical field in the first electrorheological fluid in the first compressibility zone, and the second subset of first electrodes positioned to create, in response to a voltage across the second subset of first electrodes, an electrical field in the first electrorheological fluid in the second compressibility zone, wherein at least a portion of the first foam element permeated by the first electrorheological fluid is located within at least one of the first compressibility zone and the second compressibility zone.

2. The article of footwear of claim 1, wherein the sole structure further comprises an electrically controllable second damping pad positioned in the plantar region of the sole structure and above the first damping pad, wherein the second damping pad includes a second chamber, a second foam element located within the second chamber, a second electrorheological fluid located within the second chamber and at least partially permeating the second foam element, and a set of second electrodes positioned to create, in response to a voltage across the second electrodes, an electrical field in at least a portion of the second electrorheological fluid.

3. The article of footwear of claim 2, wherein the second damping pad is directly adjacent to the first damping pad.

4. The article of footwear of claim 2, wherein the sole structure comprises a cushioning element positioned between the first damping pad and the second damping pad.

5. The article of footwear of claim 4, wherein the cushioning element is one of a compressible polymer foam element and a fluid-filled bladder.

6. The article of footwear of claim 1, wherein the first compressibility zone is substantially limited to a lateral side of the first damping pad and the second compressibility zone is substantially limited to a medial side of the first damping pad.

7. The article of footwear of claim 1, wherein the first compressibility zone is substantially limited to a forward end of the first damping pad and the second compressibility zone is substantially limited to a rear end of the first damping pad.

8. The article of footwear of claim 1, wherein the first damping pad comprises a third compressibility zone and a fourth compressibility zone, wherein none of the first, second, third, or fourth compressibility zones is conterminous with any of the other first damping pad compressibility zones, and wherein the first electrodes comprise a third subset of the first electrodes positioned in and defining the third compressibility zone, and a fourth subset of the first electrodes positioned in and defining the fourth compressibility zone.

9. The article of footwear of claim 8, wherein the first compressibility zone is substantially limited to a lateral side and a forward end of the first damping pad, the second compressibility zone is substantially limited to a medial side and the forward end of the first damping pad, the third compressibility zone is substantially limited to the lateral side and a rear end of the first damping pad, and the fourth compressibility zone is substantially limited to the medial side and the rear end of the first damping pad.

10. The article of footwear of claim 1, wherein the first chamber includes at least one wall formed from a flexible polymer.

11. The article of footwear of claim 1, wherein the first damping pad is located in a heel region of the sole structure.

12. The article of footwear of claim 1, wherein the first damping pad is located in a forefoot region of the sole structure.

13. The article of footwear of claim 1, wherein the first damping pad is located in forefoot and heel regions of the sole structure.

14. The article of footwear of claim 1, further comprising a controller including a processor and memory, at least one of the processor and memory storing instructions executable by the processor to perform operations that include receiving input identifying an activation profile, determining zones that are to be activated under the identified activation profile and an activation voltage $V_{act}$ to be applied to electrodes of each of the determined zones, and applying the determined voltages to the identified zones.

15. The article of footwear of claim 14, wherein a portion of the determined zones are zones of the first damping pad and a portion of the determined zones are zones of a second damping pad.

16. The article of footwear of claim 1, wherein the first damping pad extends substantially an entire length of the sole structure and comprises a single chamber.

17. A sole structure comprising:

an outsole; and a midsole coupled to the outsole and including a first electrically controllable damping pad positioned in a plantar region of the sole structure, wherein the first damping pad includes a first chamber, a first foam element located within the first chamber, a first electrorheological fluid located within the first chamber and at least partially permeating the first foam element, and a set of first electrodes comprising a first subset and a second subset, each electrode of the first subset and second subset of first electrodes comprising a peripheral boundary, the peripheral boundaries of the first subset positioned in and defining a first compressibility zone of the first chamber between the first subset of first electrodes and spaced inwardly of a peripheral boundary of the first chamber, the peripheral boundaries of the second subset positioned in and defining a second compressibility zone of the first chamber between the second subset of first electrodes and spaced inwardly of a peripheral boundary of the first chamber, wherein the first compressibility zone and the second compressibility zone are not coterminous, the first subset of first electrodes positioned to create, in response to a voltage across the first subset of first electrodes, an electrical field in the first electrorheological fluid in the first compressibility zone, and the second subset of first electrodes positioned to create, in response to a voltage across the second subset of first electrodes, an electrical field in the first electrorheological fluid in the second compressibility zone, wherein at least a portion of the first foam element permeated by the first electrorheological fluid is located within at least one of the first compressibility zone and the second compressibility zone.

18. The sole structure of claim 17, wherein the sole structure further comprises an electrically controllable second damping pad positioned in the plantar region of the sole structure and above the first damping pad, wherein the second damping pad includes a second chamber, a second foam element located within the second chamber, a second electrorheological fluid located within the second chamber and at least partially permeating the second foam element, and a set of second electrodes positioned to create, in response to a voltage across the second electrodes, an electrical field in at least a portion of the second electrorheological fluid.

19. The sole structure of claim 18, wherein the second damping pad is directly adjacent to the first damping pad.

20. The sole structure of claim 18, wherein the sole structure comprises a cushioning element positioned between the first damping pad and the second damping pad.

21. The sole structure of claim 20, wherein the cushioning element is one of a compressible polymer foam element and a fluid-filled bladder.

22. The sole structure of claim 17, wherein the first compressibility zone is substantially limited to a lateral side of the first damping pad and the second compressibility zone is substantially limited to a medial side of the first damping pad.

23. The sole structure of claim 17, wherein the first compressibility zone is substantially limited to a forward end of the first damping pad and the second compressibility zone is substantially limited to a rear end of the first damping pad.

24. The sole structure of claim 17, wherein the first damping pad comprises a third compressibility zone and a fourth compressibility zone, wherein none of the first, second, third, or fourth compressibility zones is conterminous with any of the other first damping pad compressibility zones, and wherein the first electrodes comprise a third subset of the first electrodes positioned in and defining the third compressibility zone, and a fourth subset of the first electrodes positioned in and defining the fourth compressibility zone.

25. The sole structure of claim 24, wherein the first compressibility zone is substantially limited to a lateral side and a forward end of the first damping pad, the second compressibility zone is substantially limited to a medial side and the forward end of the first damping pad, the third compressibility zone is substantially limited to the lateral side and a rear end of the first damping pad, and the fourth compressibility zone is substantially limited to the medial side and the rear end of the first damping pad.

26. The sole structure of claim 17, wherein the first damping pad is located in a heel region of the sole structure.

27. The sole structure of claim 17, wherein the first damping pad is located in a forefoot region of the sole structure.

28. The sole structure of claim 17, wherein the first damping pad is located in forefoot and heel regions of the sole structure.

29. The sole structure of claim 17, wherein the sole structure further comprises a controller including a processor and memory, at least one of the processor and memory storing instructions executable by the processor to perform operations that include receiving input identifying an activation profile, determining zones that are to be activated under the identified activation profile and an activation voltage $V_{act}$ to be applied to electrodes of each of the determined zones, and applying the determined voltages to the identified zones.

30. The sole structure of claim 17, wherein the first damping pad extends substantially an entire length of the sole structure and comprises a single chamber.

* * * * *